US011004391B2

(12) United States Patent
Kam et al.

(10) Patent No.: US 11,004,391 B2
(45) Date of Patent: May 11, 2021

(54) IMAGE DATA COMPENSATION BASED ON PREDICTED CHANGES IN THRESHOLD VOLTAGE OF PIXEL TRANSISTORS

(71) Applicant: Apple Inc., Cupertino, CA (US)

(72) Inventors: Hei Kam, Santa Clara, CA (US); Junhua Tan, Saratoga, CA (US); Wei H. Yao, Palo Alto, CA (US); Shihchang Chang, Cupertino, CA (US); Derek K. Shaeffer, Redwood City, CA (US); Chaohao Wang, Sunnyvale, CA (US); Hyunwoo Nho, Palo Alto, CA (US); Yun Wang, Cupertino, CA (US); Baris Cagdaser, Sunnyvale, CA (US); Majid Gharghi, San Carlos, CA (US); Yongjun Li, Fremont, CA (US); Aida Raquel Colon-Berrios, Cupertino, CA (US); Mohammad Reza Esmaeili Rad, San Jose, CA (US); Hyunsoo Kim, Mountain View, CA (US); Alex H. Pai, Milpitas, CA (US); Hsin-Ying Chiu, San Jose, CA (US); Jiun-Jye Chang, Cupertino, CA (US); Ching-Sang Chuang, Sunnyvale, CA (US); Xin Lin, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/869,329

(22) Filed: May 7, 2020

(65) Prior Publication Data

US 2020/0388215 A1 Dec. 10, 2020

Related U.S. Application Data

(60) Provisional application No. 62/859,603, filed on Jun. 10, 2019.

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/3291* (2013.01); *G09G 3/3648* (2013.01);
(Continued)

(58) Field of Classification Search
CPC ..... G09G 2300/0842; G09G 2300/0847; G09G 2300/0861; G09G 2320/0233;
(Continued)

(56) References Cited

U.S. PATENT DOCUMENTS 8,427,512 B2 * 4/2013 Smith ..... G09G 3/3216 345/690
9,093,029 B2 * 7/2015 Chaji ..... H03F 3/2171
9,721,502 B2 * 8/2017 Bi ..... G09G 3/3233
9,851,459 B2 * 12/2017 Tredwell ..... G01T 1/247
(Continued)

*Primary Examiner* — Tony O Davis
(74) *Attorney, Agent, or Firm* — Fletcher Yoder, P.C.

(57) ABSTRACT

An electronic device includes an electronic display having an active area comprising a pixel. The electronic device also includes processing circuitry configured to receive image data and predict a change in threshold voltage associated with a transistor of the pixel based at least in part on the image data. Furthermore, the processing circuitry is configured to adjust the image data to generate adjusted image data based at least in part on the predicted change in threshold voltage.

20 Claims, 23 Drawing Sheets

(51) Int. Cl.
*G09G 3/36* (2006.01)
*G09G 3/3291* (2016.01)

(52) U.S. Cl.
CPC ..... *G09G 2300/0847* (2013.01); *G09G 2320/0233* (2013.01); *G09G 2320/0295* (2013.01)

(58) Field of Classification Search
CPC ..... G09G 2320/0285; G09G 2320/0295; G09G 2320/041; G09G 2320/045; G09G 2320/048; G09G 2320/064; G09G 2340/16; G09G 3/3233; G09G 3/3291; G09G 3/3648
USPC ..... 345/690
See application file for complete search history.

(56) References Cited

U.S. PATENT DOCUMENTS

| | | | | |
|---|---|---|---|---|
| 9,852,685 | B2 * | 12/2017 | Duan | G09G 3/3233 |
| 10,152,915 | B2 * | 12/2018 | Chaji | G09G 3/3208 |
| 10,170,046 | B2 * | 1/2019 | Xie | G09G 3/3258 |
| 10,269,278 | B2 * | 4/2019 | Lin | G09G 3/2096 |
| 2007/0040548 | A1 * | 2/2007 | Sakaguchi | G09G 3/006 324/762.07 |
| 2010/0026725 | A1 * | 2/2010 | Smith | G09G 3/3233 345/690 |
| 2017/0193881 | A1 * | 7/2017 | Kim | G09G 3/2074 |
| 2018/0082634 | A1 * | 3/2018 | Wang | G09G 3/3233 |
| 2019/0164503 | A1 * | 5/2019 | An | G09G 3/3258 |
| 2020/0066356 | A1 * | 2/2020 | Lee | G06F 3/0604 |
| 2020/0219448 | A1 * | 7/2020 | Okamoto | G09G 3/3275 |

* cited by examiner

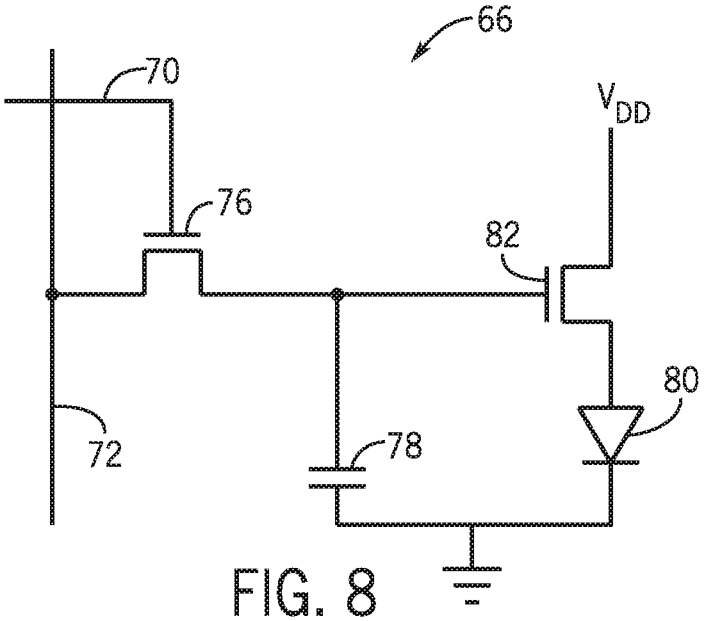
FIG. 8
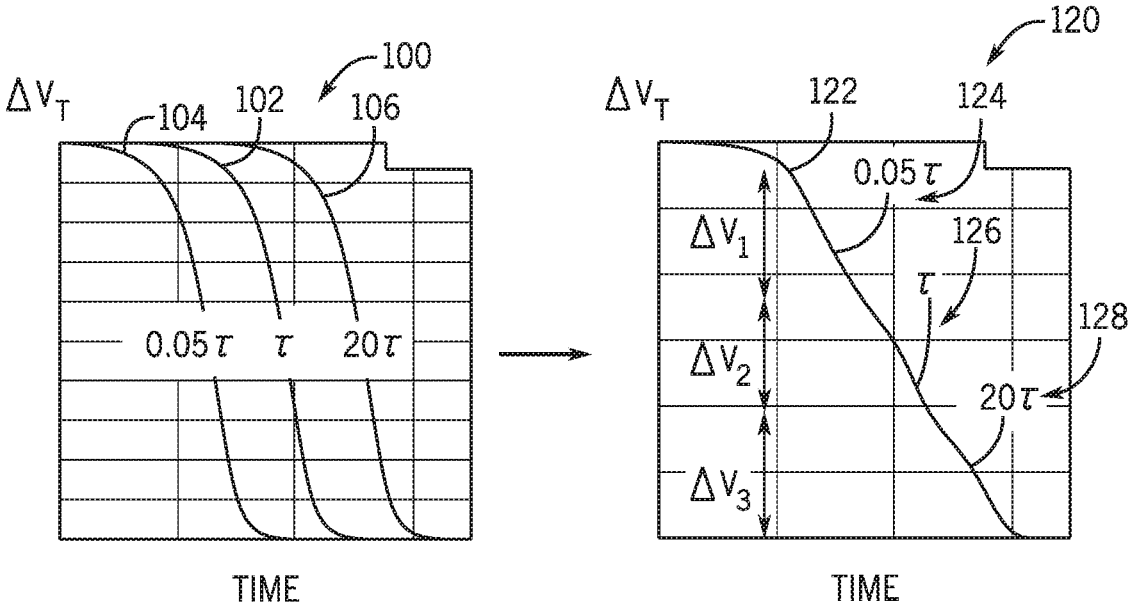
FIG. 9
140
$$\Delta V_{th} = \Delta V_1 + \Delta V_2 + \Delta V_3 + \cdots$$
FIG. 10

400

402 404 406

| GRAY LEVEL | $\tau$ | $\Delta V_{final}$ |
|---|---|---|
| 255 | $\tau_0$ | $\Delta V_{final,0}$ |
| 255 | $\tau_1$ | $\Delta V_{final,1}$ |
| | ⋮ | ⋮ |
| 255 | $\tau_{n-1}$ | $\Delta V_{final,n-1}$ |
| 255 | $\tau_n$ | $\Delta V_{final,n}$ |
| ⋮ | | |
| 0 | $\tau_0$ | $\Delta V_{final,0}$ |
| 0 | $\tau_1$ | $\Delta V_{final,1}$ |
| | ⋮ | ⋮ |
| 0 | $\tau_n$ | $\Delta V_{final,n}$ |

FIG. 29

IMAGE DATA COMPENSATION BASED ON PREDICTED CHANGES IN THRESHOLD VOLTAGE OF PIXEL TRANSISTORS

CROSS-REFERENCE TO RELATED APPLICATIONS

This application claims the benefit of U.S. Patent Application No. 62/859,603, entitled "Image Data Compensation Based on Predicted Changes in Threshold Voltage of Pixel Transistors," filed on Jun. 10, 2019, which is incorporated by reference herein in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to compensating image data for predicted changes in threshold voltage associated with transistors (e.g., thin film transistors (TFTs)) found in pixels of electronic displays, such as light emitting diode (LED) displays, organic light emitting diode (OLED) displays, active matrix organic light emitting diode (AMOLED) displays, micro LED (μLED) displays, or any other suitable form of electronic display. Under certain conditions, non-uniformity of a display induced by hysteresis in transistors of pixels, process non-uniformity temperature gradients, or other factors across the display can be compensated for to increase performance of a display (e.g., reduce visible anomalies). The non-uniformity of pixels in a display may vary between devices of the same type (e.g., two similar phones, tablets, wearable devices, or the like), it can vary over time and usage (e.g., due to aging and/or degradation of the pixels or other components of the display), and/or it can vary with respect to temperatures, as well as in response to additional factors. Furthermore, "image sticking," which refers to an image or portion of an image persisting, or still being displayed, longer than the image or portion thereof should be displayed, may also occur. For example, content from one frame of content may still be visible to the human eye after a subsequent frame of content is displayed. In some cases, this may be due to hysteresis of driver TFTs of the pixels of the display (e.g., a lag between a present input and a past input affecting the operation of the driver TFTs).

As described below, a predicted (e.g., expected) threshold voltage or change in threshold voltage for image data for a given pixel may be determined based on the image data itself and several other factors such temperature, pulse-width modulation (PWM) of image data signals, a state of a display (e.g., on or off), and a pixel's location within the electronic display. The image data may be modified to account for the predicted change in threshold voltage. Accordingly, the techniques described below may reduce and/or eliminate the occurrence of image sticking perceivable to the human eye.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 8 is a block diagram of a pixel of the electronic display of FIG. 7, in accordance with an embodiment;

FIG. 9 illustrates a first graph showing lines indicative of changes in threshold voltage of a transistor of a pixel of the electronic display of FIG. 7 that occur at different rates and a second graph showing a line indicative of the sum of the lines of the first graph, in accordance with an embodiment;

FIG. 10 is an equation that may be utilized to determine a change in threshold voltage associated with a frame of image data, in accordance with an embodiment;

FIG. 29 is a table of device parameters, in accordance with an embodiment.

DETAILED DESCRIPTION OF SPECIFIC EMBODIMENTS

Figure 1:
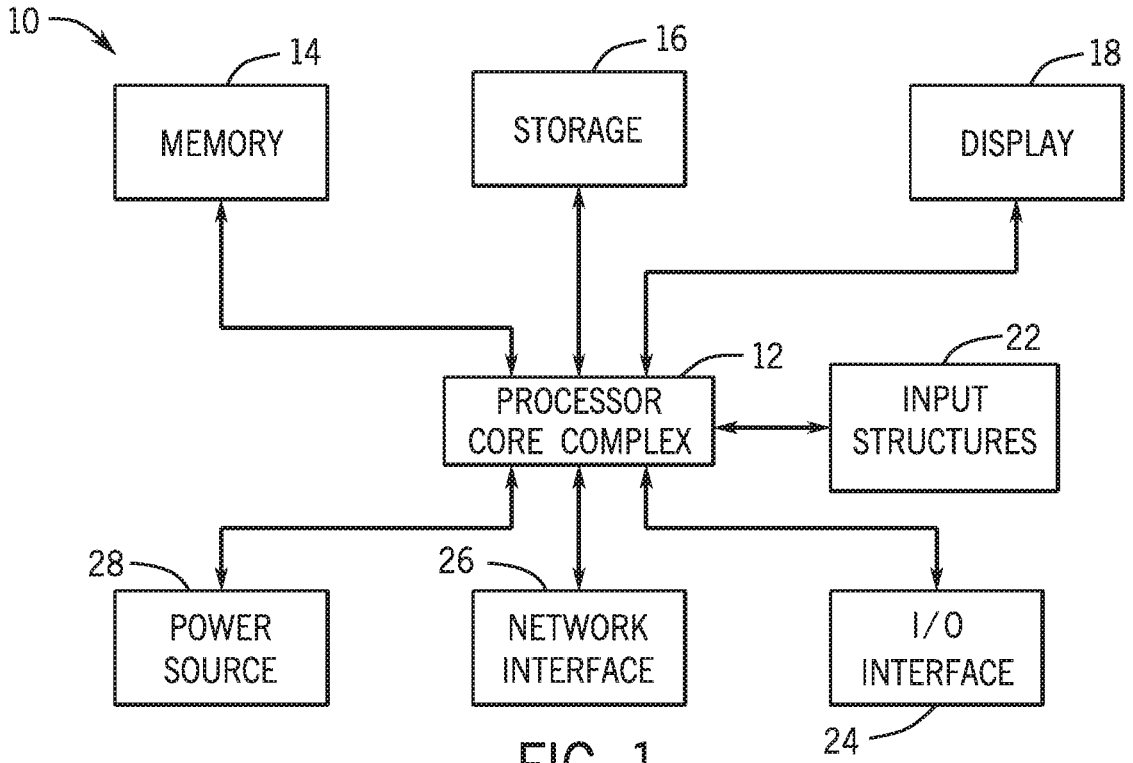
FIG. 1 is a schematic block diagram of an electronic device that compensates image data, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based on the image data. By programming different pixels with different image data, graphical content including images, videos, and text can be displayed.

Display panel sensing allows for operational properties of pixels of an electronic display to be identified to improve the performance of the electronic display. For example, variations in temperature and pixel aging (among other things) across the electronic display cause pixels in different locations on the display to behave differently. For instance, a threshold voltage associated with a transistor utilized to cause a pixel to emit light (e.g., to display image data) may change over time as content (e.g., frames of video content, still images, etc.) is shown. Changes to threshold voltage associated with the transistor, in some cases, may cause visible changes to the content displayed (e.g., change in luminance, perceived change in coloration of content) as well as result in visual artifacts.

As discussed below, presently disclosed techniques enable threshold voltages for pixels in a display to be predicted. Based on the predicted threshold voltages or predicted changes in threshold voltage, image data may be modified so that the content ultimately provided by an electronic display more closely resembles content of the original image data. That is, expected changes to pixels (e.g., changes in threshold voltage associated with a transistor) may be taken into account so that image data to be presented by the pixels may be modified to account for the expected changes to the pixels. By doing so, the occurrence of image sticking may be reduced and/or eliminated, and the uniformity of electronic displays may be improved.

Figure 2:
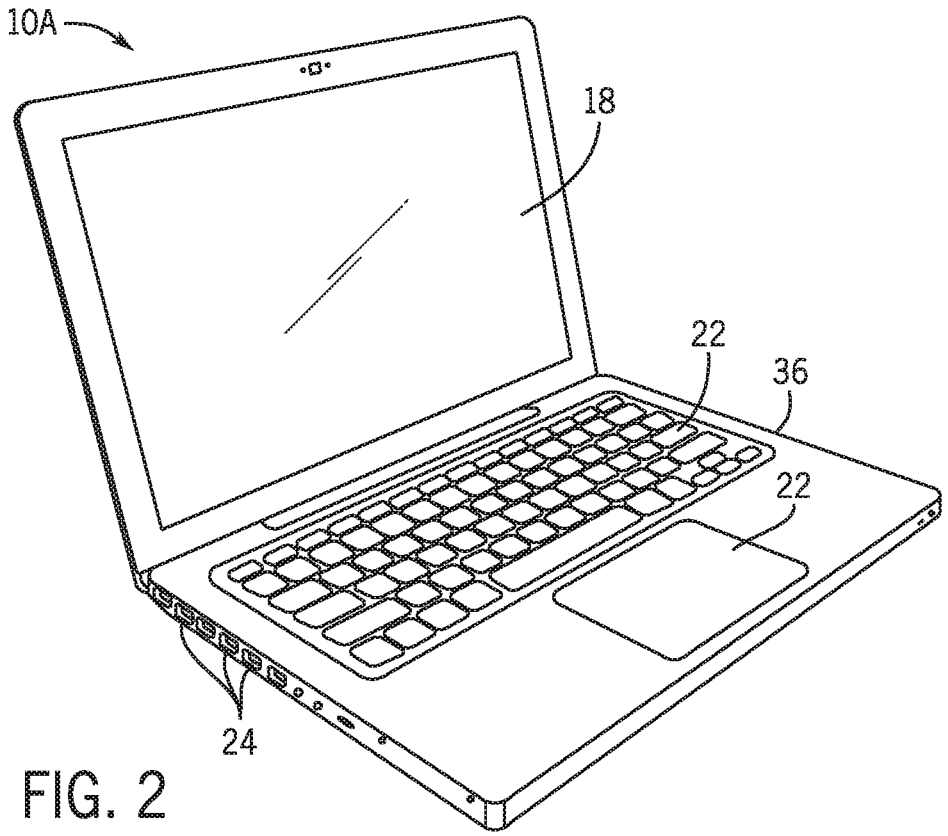
FIG. 2 is a perspective view of a notebook computer representing an embodiment of the electronic device of FIG. 1.
Figure 4:
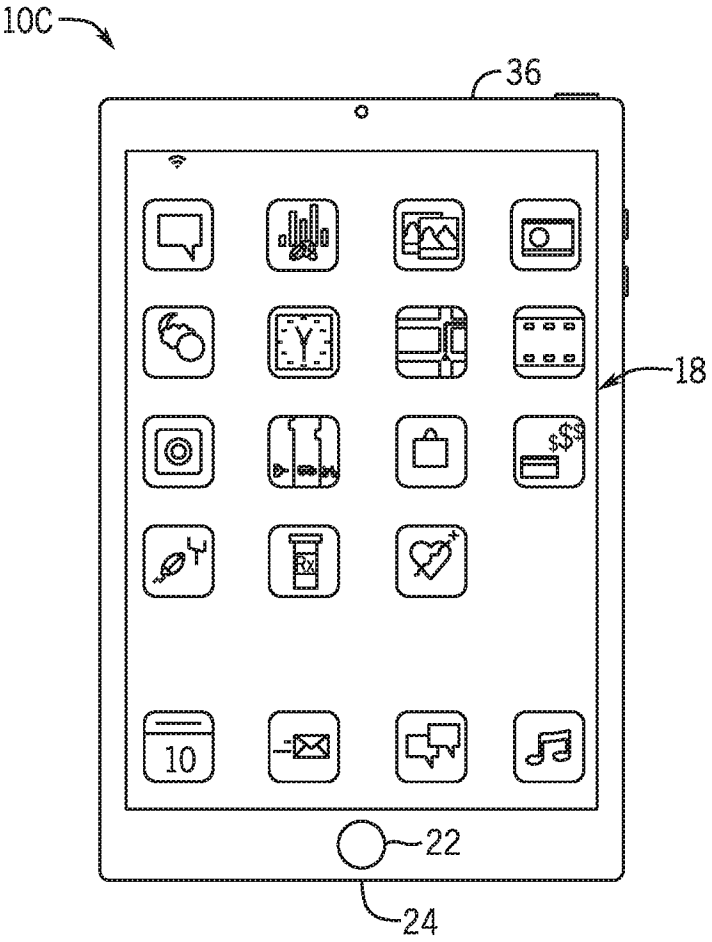
FIG. 4 is a front view of another hand-held device representing another embodiment of the electronic device of FIG. 1.
Figure 3:
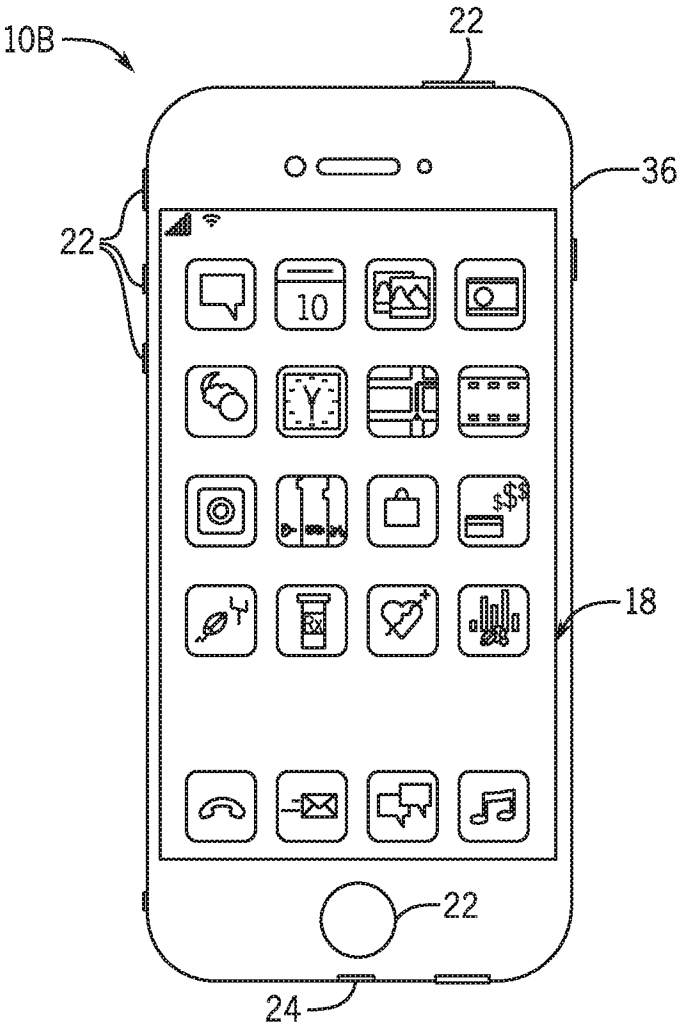
FIG. 3 is a front view of a hand-held device representing another embodiment of the electronic device of FIG. 1.
Figure 5:
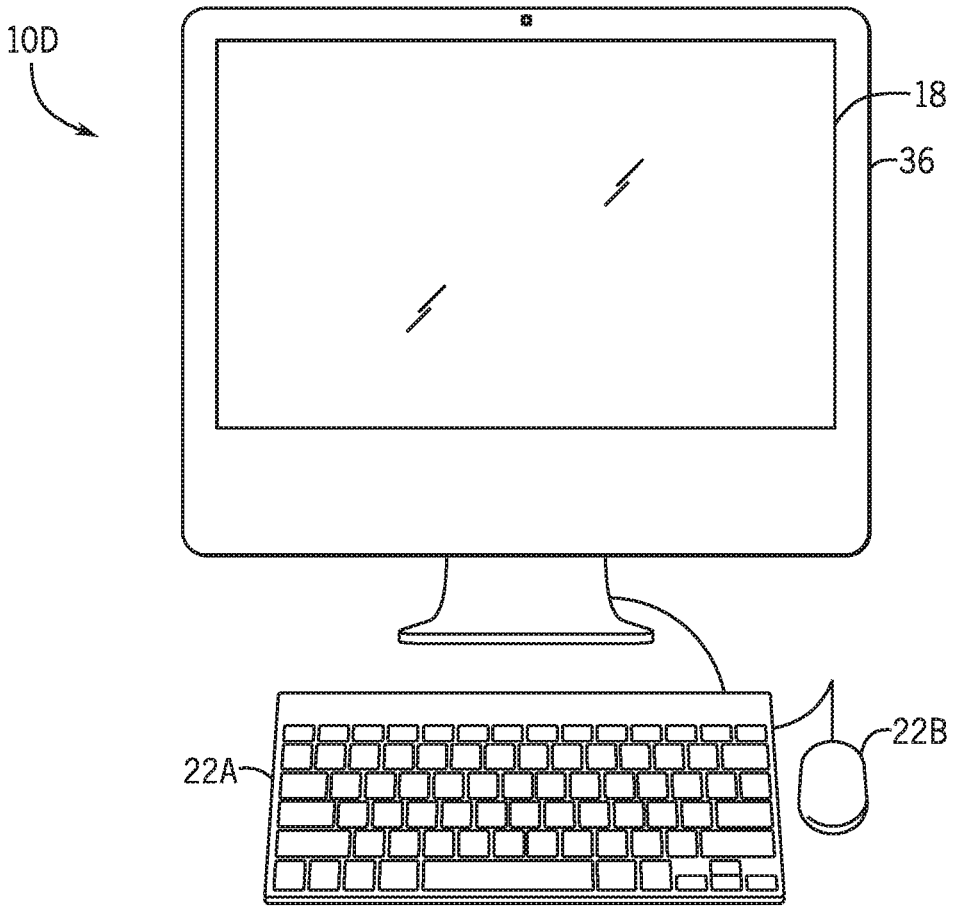
FIG. 5 is a front view of a desktop computer representing another embodiment of the electronic device of FIG. 1.
Figure 6:
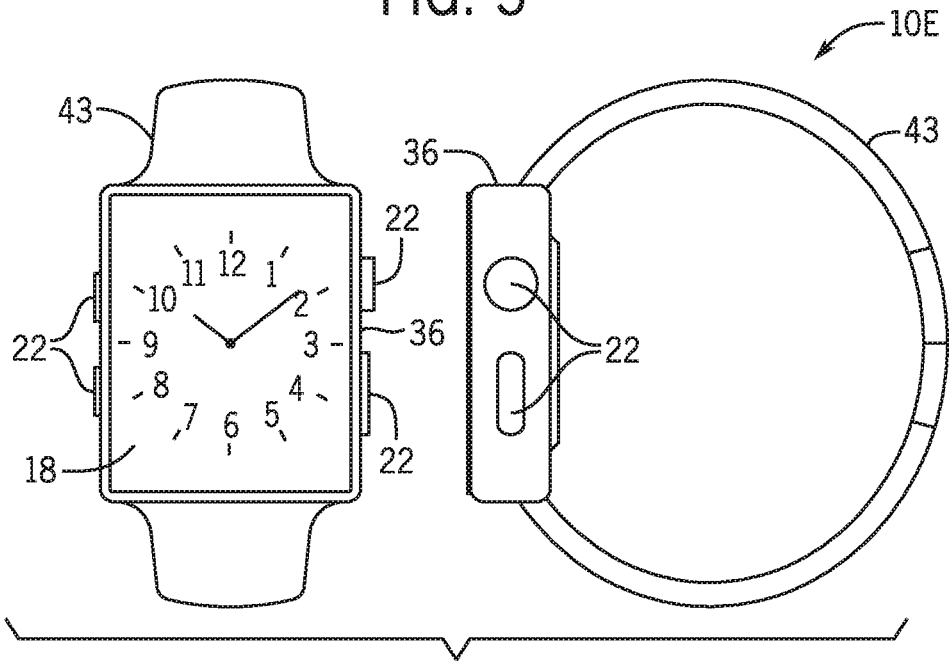
FIG. 6 is a front view and side view of a wearable electronic device representing another embodiment of the electronic device of FIG. 1.

With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as provide image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 or the electronic display 18 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal serial bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device.

By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
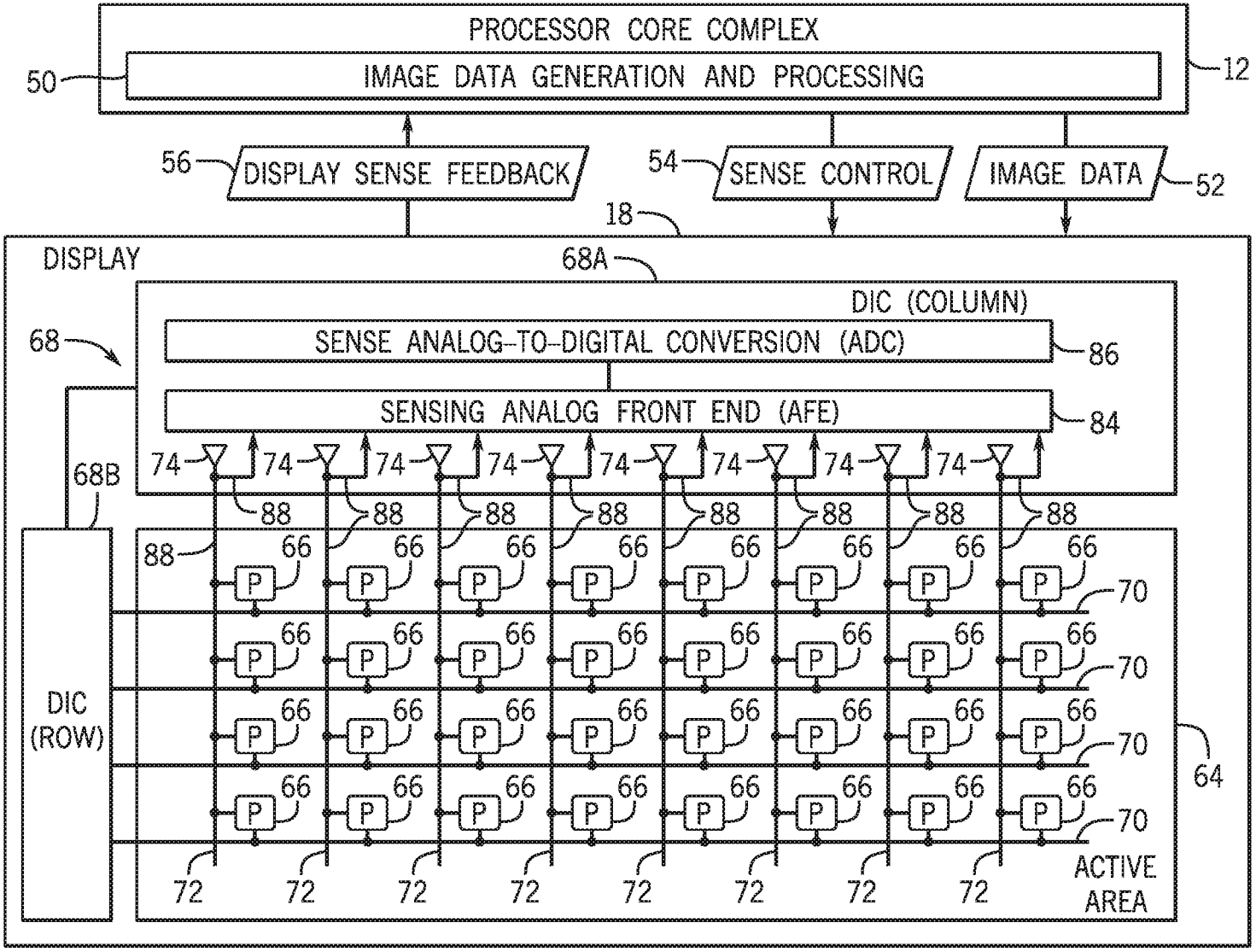
FIG. 7 is a block diagram of an electronic display of FIG. 1, in accordance with an embodiment.

As shown in FIG. 7, in the various embodiments of the electronic device 10, the processor core complex 12 may utilize image data generation and processing circuitry 50 to generate image data 52 for display by the electronic display 18. The image data generation and processing circuitry 50 of the processor core complex 12 is meant to represent the various circuitry and processing that may be employed by the processor core complex 12 to generate the image data 52 and control the electronic display 18. As illustrated, the image data generation and processing circuitry 50 may be externally coupled to the electronic display 18. However, in other embodiments, the image data generation and processing circuitry 50 may be part of the electronic display 18. In some embodiments, the image data generation and processing circuitry 50 may represent a graphics processing unit, a display pipeline, or the like that may be utilized to facilitate control of operation of the electronic display 18. The image data generation and processing circuitry 50 may include a processor and memory such that the processor of the image data generation and processing circuitry 50 may execute instructions and/or process data stored in memory of the image data generation and processing circuitry 50 to control operation in the electronic display 18.

As previously discussed, it may be desirable to compensate image data 52, for example, based on operational variations of the electronic display 18, such as predicted changes in threshold voltage associated with transistors of pixels included in the electronic display 18. The processor core complex 12 may provide sense control signals 54 to cause the electronic display 18 to perform display panel sensing to generate display sense feedback 56. The display sense feedback 56 represents digital information relating to the operational variations of the electronic display 18. The display sense feedback 56 may take any suitable form, and may be converted by the image data generation and processing circuitry 50 into a compensation value that, when applied to the image data 52, appropriately compensates the image data 52 for the conditions of the electronic display 18. For example, the image data 52 for a particular pixel may be modified based on a predicted change in threshold voltage associated with the pixel. This results in greater fidelity of the image data 52, reducing or eliminating visual artifacts that might otherwise occur due to the operational variations of the electronic display 18.

The electronic display 18 includes an active area 64 with an array of pixels 66. The pixels 66 are schematically shown distributed substantially equally apart and of the same size, but in an actual implementation, pixels of different colors may have different spatial relationships to one another and may have different sizes. In one example, the pixels 66 may take a red-green-blue (RGB) format with red, green, and blue pixels, and in another example, the pixels 66 may take a red-green-blue-green (RGBG) format in a diamond pattern. The pixels 66 are controlled by a driver integrated circuit (IC) 68, which may be a single module or may be made up of separate modules, such as a column driver IC 68A and a row driver IC 68B. The driver IC 68 (e.g., row driver 68B) may send signals across gate lines 70 to cause a row of pixels 66 to become activated and programmable, at which point the driver IC 68 (e.g., column driver IC 68A) may transmit image data signals across data lines 72 to program the pixels 66 to display a particular gray level (e.g., individual pixel brightness). By supplying different pixels 66 of different colors with image data to display different gray levels, full-color images may be programmed into the pixels 66. The image data may be driven to an active row of pixels 66 via source drivers 74, which are also sometimes referred to as column drivers.

As described above, the electronic display 18 may display image frames through control of its luminance of its pixels 66 based at least in part on received image data. When a pixel 66 is activated (e.g., via a gate activation signal across a gate line 70 activating a row of pixels 66), luminance of a display pixel 66 may be adjusted by image data received via a data line 72 coupled to the pixel 66. Thus, as depicted, each pixel 66 may be located at an intersection of a gate line 70 (e.g., a scan line) and a data line 72 (e.g., a source line). Based on received image data, each pixel 66 may adjust its luminance using electrical power supplied from a power supply, for example, via power a supply lines coupled to the pixel 66.

As illustrated in FIG. 8, each pixel 66 may include a circuit switching thin-film transistor (TFT) 76, a storage capacitor 78, an LED 80, and a driver TFT 82. The storage capacitor 78 and the LED 80 may be coupled to a common voltage, Vcom, or ground. However, variations may be utilized in place of illustrated pixel 66 of FIG. 8. To facilitate adjusting luminance, the driver TFT 82 and the circuit switching TFT 76 may each serve as a switching device that is controllably turned on and off by voltage applied to its respective gate. In the depicted embodiment, the gate of the circuit switching TFT 76 is electrically coupled to a gate line 70. Accordingly, when a gate activation signal received from its gate line 70 is above its threshold voltage, the circuit switching TFT 76 may turn on, thereby activating the pixel 66 and charging the storage capacitor 78 with image data received at its data line 72.

Additionally, in the depicted embodiment, the gate of the driver TFT 82 is electrically coupled to the storage capacitor 78. As such, voltage of the storage capacitor 78 may control operation of the driver TFT 82. More specifically, in some embodiments, the driver TFT 82 may be operated in an active region to control magnitude of supply current flowing through the LED 80 (e.g., from a power supply or the like providing Vdd). In other words, as gate voltage (e.g., storage capacitor 78 voltage) increases above its threshold voltage, the driver TFT 82 may increase the amount of its channel available to conduct electrical power, thereby increasing supply current flowing to the LED 80. On the other hand, as the gate voltage decreases while still being above its threshold voltage, the driver TFT 82 may decrease amount of its channel available to conduct electrical power, thereby decreasing supply current flowing to the LED 80. In this manner, the luminance of the pixel 66 may be controlled and, when similar techniques are applied across the electronic display 18 (e.g., to the pixels 66 of the electronic display 18), an image may be displayed.

As mentioned above, the pixels 66 may be arranged in any suitable layout with the pixels 66 having various colors and/or shapes. For example, the pixels 66 may appear in alternating red, green, and blue in some embodiments, but also may take other arrangements. The other arrangements may include, for example, a red-green-blue-white (RGBW) layout or a diamond pattern layout in which one column of pixels alternates between red and blue and an adjacent column of pixels are green. Regardless of the particular arrangement and layout of the pixels 66, each pixel 66 may be sensitive to changes on the active area 64 of the electronic display 18, such as variations in content to be displayed, temperature of the active area 64, and the overall age of the pixel 66. Indeed, when each pixel 66 is a light emitting diode (LED), it may gradually emit less light over time. This effect is referred to as aging, and takes place over a slower time period than the effect of temperature on the pixel 66 of the electronic display 18. For example, a threshold voltage associated with the driver TFT 82 may change over time. Changes to the threshold voltage of the driver TFT 82 of pixels 66 of the electronic display 18 may cause an inaccurate amount of current to LEDs 80, which may cause displayed content to differ from content reflected by the image data 52.

Returning to FIG. 7, display panel sensing may be used to obtain the display sense feedback 56, which may enable the processor core complex 12 or driver IC 68 to generate compensated image data 52 to negate changes in threshold voltage associated with the driver TFTs 82 of the pixels 66. The driver IC 68 (e.g., column driver IC 68A) may include a sensing analog front end (AFE) 84 to perform analog sensing of the response of pixels 66 to test data. The analog signal may be digitized by sensing analog-to-digital conversion circuitry (ADC) 86.

For example, to perform display panel sensing, the electronic display 18 may program one of the pixels 66 with test data (e.g., having a particular reference voltage or reference current). The sensing analog front end 84 then senses (e.g., measures, receives, etc.) at least one value (e.g., voltage, current, etc.) along sense line 88 of connected to the pixel 66 that is being tested. Here, the data lines 72 are shown to act as extensions of the sense lines 88 of the electronic display 18. In other embodiments, however, the active area 64 may include other dedicated sense lines 88 or other lines of the electronic display 18 may be used as sense lines 88 instead of the data lines 72. In some embodiments, other pixels 66 that have not been programmed with test data may be also sensed at the same time a pixel 66 that has been programmed with test data is sensed. Indeed, by sensing a reference signal on a sense line 88 when a pixel 66 on that sense line 88 has not been programmed with test data, a common-mode noise reference value may be obtained. This reference signal can be removed from the signal from the test pixel 66 that has been programmed with test data to reduce or eliminate common mode noise.

The analog signal may be digitized by the sensing ADC conversion circuitry 86. The sensing analog front end 84 and the sensing ADC conversion circuitry 86 may operate, in effect, as a single unit. The driver IC 68 (e.g., the column driver IC 68A) may also perform additional digital operations to generate the display sense feedback 56, such as digital filtering, adding, or subtracting, to generate the display sense feedback 56, or such processing may be performed by the processor core complex 12.

Estimating Changes in Threshold Voltage for Image Data to be Displayed

As described below, a model may be applied to threshold voltage values associated with a pixel to predict a change to the threshold voltage associated with a subsequent frame of content. For example, instructions utilized to cause the processor core complex 12 or driver IC 68 to utilize the model to make such predictions may be stored on the local memory 14, storage 16, or memory that may be included in the electronic device 10. In other embodiments, the model may be part of the image data generation and processing circuitry 50 (e.g., stored in memory therein). For example, values included in the model may be stored in a look-up table or the like. The processor core complex 12 or driver IC 68 may estimate the threshold voltage of a driver TFT 82 of a pixel 66 for a subsequent frame of content to be displayed and modify the image data 52 being transmitted to the pixels 66 based on estimated changes to threshold voltage of the driver TFT 82.

Part of the modeling discussed herein accounts for the trapping and detrapping of charge within the driver TFTs 82. Throughout the lifetime of driver TFT 82, charge may accumulate in, and dissipate out of, the driver TFT 82 at different rates. Accordingly, to account for these different rates, the model discussed herein may include multiple "traps," meaning that the model accounts for various rates at which charge trapping and detrapping occurs. As discussed below with respect to FIG. 9 and FIG. 10, a change in threshold voltage associated with the driver TFTs 82 may be related to a change in threshold voltage associated with each of the traps included in the model.

With the foregoing in mind, FIG. 9 illustrates two graphs, graph 100 and graph 120. The graph 100 illustrates shifts in threshold voltages associated with three different traps, each of which is associated with a different time constant. For example, one line 102 is associated with a time constant, $\tau$, another line 104 is associated with a time constant that is one twentieth of $\tau$ (e.g., $0.05\tau$), and another line 106 is associated with a time constant that is twenty times $\tau$ (e.g., $20\tau$). Each of the lines 102, 104, 106 is representative of charge trapping and detrapping occurring at different rates. For example, line 102 shows trapping and detrapping occurring earlier (e.g., at a faster rate) than line 106 but later (e.g., at a slower rate) than line 104.

The graph 120 illustrates a line 122 that is indicative of the sum of the lines 102, 104, 106. In other words, the line 122 corresponds to an equation obtained by summing the equations associated with the lines 102, 104, 106 of the graph 100. Because the line 122 is the sum of the lines 102, 104, and 106, various portions of the line 122 may be associated with the time constants of the lines 102, 104, 106. For example, as illustrated in the graph 120, a portion 124 may be associated with 0.05τ, another portion 126 may be associated with τ, and yet another portion 128 of the line 122 may be associated 20T. Additionally, each of the portions 124, 126, 128 may be associated with different changes in threshold voltage of the transistor, such as a driver TFT 82 of pixel 66 of the electronic display 18. For instance, portion 124 may be associated with a change in voltage $\Delta V_1$, portion 126 may be associated with a change in voltage $\Delta V_2$, and portion 128 may be associated with a change in voltage $\Delta V_3$. As discussed below, the sum of the changes in voltage (e.g., change in threshold voltage associated with a driver TFT 82) may be utilized in estimating a change in threshold voltage associated with a subsequent frame of content to be displayed.

However, before continuing with the drawings, it should be noted that while the discussion above relates to three traps, different numbers of traps may be included in the model. For example, as few as a single trap may be utilized in some embodiments, while, in other embodiments, many more than three traps could be utilized (e.g., tens or hundreds of traps). Additionally, as discussed below, the number of traps may differ from time to time. For example, depending on settings associated with the electronic device or characteristics of the electronic device 10, different numbers of traps (and time constants) may be used. For instance, using relatively fewer traps may enable the electronic device 10 to use less processing power and conserve battery power relative to using more traps.

Keeping the discussion of FIG. 9 in mind, FIG. 10 illustrates an equation 140, which provides that the change in threshold voltage associated with a driver TFT 82 of a pixel 66 of the electronic display 18 is equal to the sum of the voltages (e.g., changes in voltage) associated with each trap utilized in the model. For example, a model having three traps, such as the model described above with respect to FIG. 9, the change in threshold voltage would be equal to the sum of the $\Delta V_1$, $\Delta V_2$, and $\Delta V_3$ illustrated in the graph 120.

As also described above, each trap utilized in the model may be associated with a time constant. That is, each trap may be associated with a different amount of time, such as amount of time indicative of how often charge trapping and detrapping occurs. Accordingly, because each of the voltages that are added together to obtain the change in threshold in voltage are associated with a different trap, each of these voltages may also be associated with an amount of time. As discussed below, the time constants associated with each trap may be modified based on several factors, including, but not limited to, content (e.g., image data 52), temperature, pulse-width modification duty cycle, a status of the electronic display 18 (e.g., on/off status), a location of a pixel, and for what purpose a user is using the electronic device 10.

Figure 11:
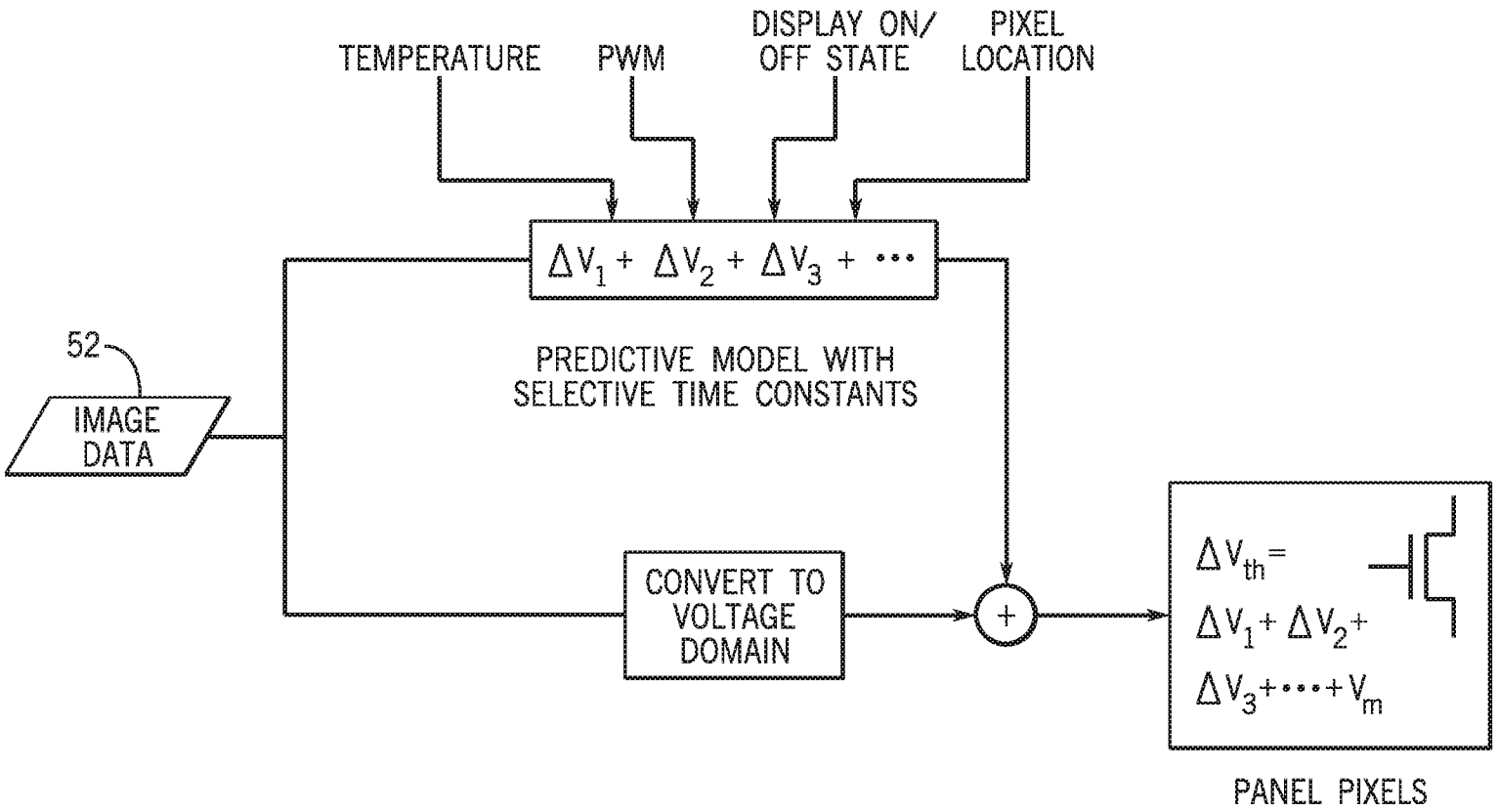
FIG. 11 is a diagram of process for predictively compensating image data based on estimated changes in threshold voltage associated with a transistor of a pixel, in accordance with an embodiment.

With the foregoing in mind, FIG. 11 is a diagram illustrating a process for predictively compensating image data based on estimated changes in threshold voltage associated with a transistor of a pixel. For example, FIG. 11 is applicable to the driver TFTs 82 of the pixels 66 of the electronic display 18 of the electronic device 10. As illustrated, image content (e.g., image data 52) may be provided into a model, such as a predictive model that utilizes time constants (e.g., τ) based on content (e.g., image data 52), temperature, pulse-width modification duty cycle, a status of the electronic display 18 (e.g., on/off status), a location of a pixel within the electronic display 18, and for what purpose a user is using the electronic device 10. The model may be implemented by the processor core complex 12, driver IC 68, the image data generation and processing circuitry 50, or a combination thereof, for example, by executing instructions stored in memory (e.g., local memory 14, storage 16, memory included in the image data generation and processing circuitry 50).

Based on the image data and the model, the image data 52 provided to the pixels 66 of the electronic display 18 may be modified. For example, image data 52 may be converted from digital to analog (e.g., converted to a voltage), and the voltage may be modified, for instance, by a signal provided by the processor core complex 12, driver IC 68, or the image data generation and processing circuitry 50. A capacitor (e.g., capacitor 78) of a pixel 66 of the electronic display 18 may store a charge associated with the modified voltage, and, when instructed to display the image data (e.g., modified image data), the LED 80 may emit light based on the charge stored in the capacitor 78. In other words, a voltage associated with the image data 52 may be modified to account for a change in threshold voltage associated with the image data 52.

Figure 12:
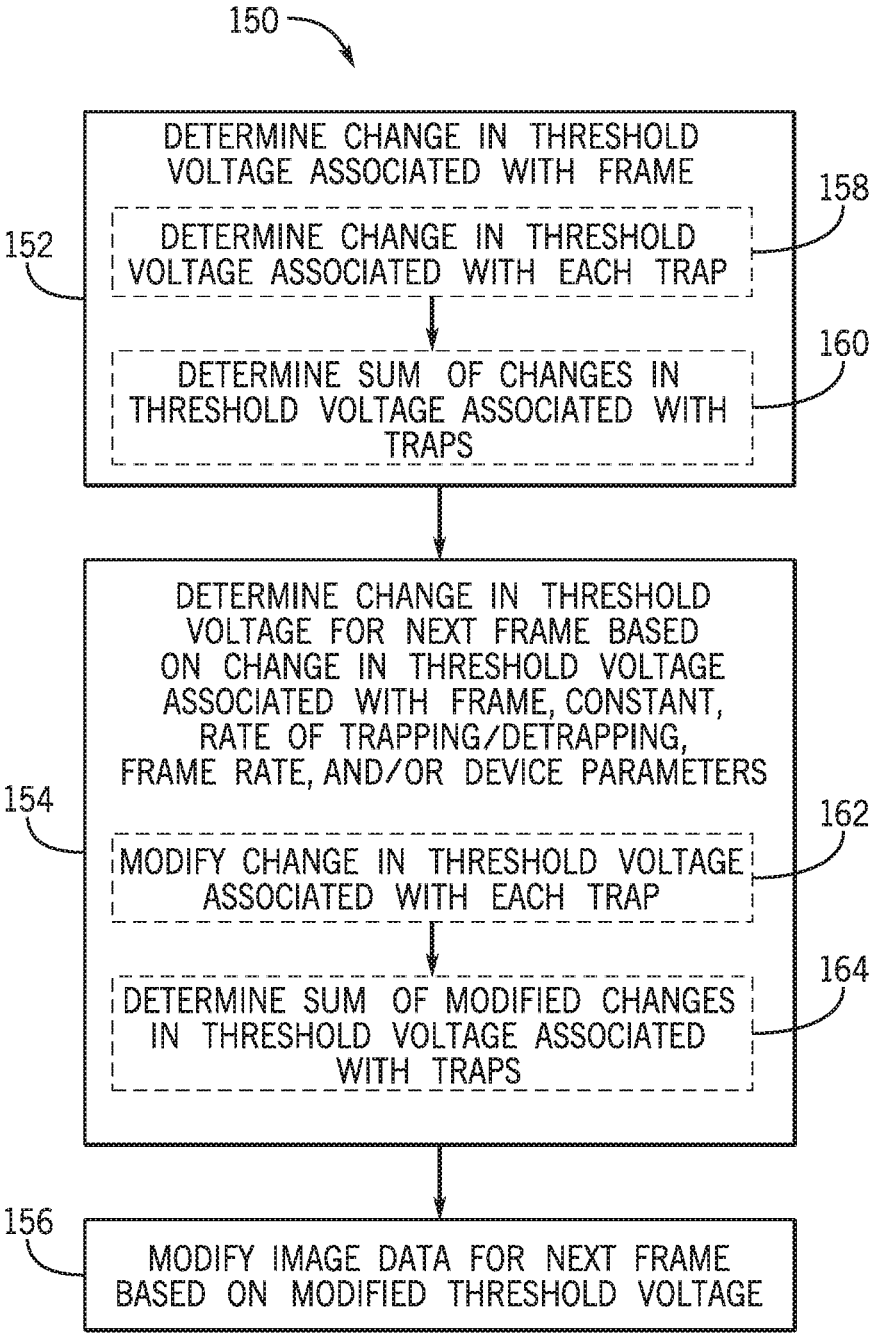
FIG. 12 is a flow diagram of a process for compensating image data based on predicted changes in threshold voltage, in accordance with an embodiment.

To help elaborate on the discussion of FIG. 11, FIG. 12 is provided. In particular, FIG. 12 is a flow diagram of a process 150 for compensating image data based on predicted changes in threshold voltage. The process 150 may be performed by the electronic device 10. More specifically, the processor core complex 12, the electronic display 18, the driver IC 68, the image data generation and processing circuitry 50, or a combination thereof may perform the process 150 by implementing the model discussed above with respect to FIG. 10 on the image data 52. For example, the process 150 may be performed for each pixel 66 of the electronic display 18. As illustrated, the process 150 generally includes determining a change in threshold voltage associated with a frame of image content (process block 152), determining a change in threshold voltage associated with a next frame of content based on the change in threshold voltage associated with the frame of content, a constant, a rate of trapping/detrapping, a frame rate associated with image data 52, and/or device parameters (process block 154), and modifying image data for the next frame of content based on the determined change in threshold voltage for the next frame of content (process block 156).

At process block 152, the electronic device 10 may determine a change in threshold voltage associated with a frame of image content. For example, for a first frame of content, the processor core complex 12, the electronic display 18, the driver IC 68, the image data generation and processing circuitry 50, or a combination thereof may determine a change in threshold voltage associated with a transistor (e.g., TFT 82) of a pixel 66 of the electronic display 18 by determining a change in threshold voltage associated with each trap of a model (process sub-block 158) and determining a sum of the changes in threshold voltage associated with the traps (process sub-block 160). In other words, the electronic device 10 may follow the equation 140 illustrated in FIG. 10. In some embodiments, the change in threshold voltage associated with the frame of image content may have been determined in a previous iteration of the process 150 and stored for future use. For instance, if in a present iteration of the process 150 the frame of content were frame i, in a previous iteration of the process 150 when the frame i was frame i+1, the frame i of image content was the next frame of content to be displayed. Such values may be stored in the local memory 14, storage 16, memory associated with the electronic display 18, or as discussed below, stored in capacitors 78 of pixels 66 of the electronic display 18, such as pixels 66 that may not be utilized to display the image data 52.

At process block 154, the electronic device 10 may determine a change in threshold voltage associated with a next frame of content based on the change in threshold voltage associated with the frame of content, a constant, a rate of trapping/detrapping, a frame rate associated with the image data 52, and/or device parameters. More specifically, at process sub-block 162, the electronic device 10 may, for each trap, determine the change in threshold voltage associated with the next frame of content by modifying the change in threshold voltage (e.g., as determined at process block 152) based on a constant, a rate of trapping/detrapping, a frame rate associated with the image data 52, and/or device parameters. Additionally, at process sub-block 164, the electronic device 10 may determine a sum of the modified changes in threshold voltage associated with each trap to determine the change in threshold voltage associated with the next frame of content.

As mentioned above with respect to process block 154, changes in threshold voltage associated with one frame of content (e.g., as determined at process block 152) may be modified based on several factors (e.g., a constant, a rate of trapping/detrapping, a frame rate associated with the image data 52, and/or device parameters) to determine the change in threshold voltage associated with the next frame of content. Each of these factors will now be discussed.

The constant may be the trapping constant, $\tau$, or each trapping constant $\tau$ included in the model being utilized. The rate of trapping/detrapping may be defined by the trapping constant(s). For example, a trapping constant of $0.5\tau$ indicates that trapping and detrapping of charge within the driver TFT 82 of the pixels 66 of the electronic display 18 occur half as often as trapping constant $\tau$. The frame rate refers to the number of frames of content are included in the image data 52 for a given time period. For example, the frame rate may be a certain number of frames per second (FPS), such as 30 FPS, 60 FPS, 120 FPS, 240 FPS, or other amounts of frames per second. The device parameters are values that may be associated with a particular electronic display 18 and/or electronic device 10. For example, the device parameters may include data values associated with each gray level (e.g., G0-G255). For instance, the device parameters may include changes in voltage (e.g., values of $\Delta V$) associated with each time constant for each gray level as well as the values of the time constants for each gray level. Determination of the device parameters is discussed below with respect to FIGS. 22-29.

Continuing the discussion of the process 150, at process block 156, the electronic device 10 may modify the image data 52 for the next frame of content based on the modified threshold voltage. In other words, the electronic device 10 may modify the image data 52 pertaining to the next frame of content based on the change in threshold voltage determined at process block 154.

As discussed above, the process 150 may be implemented on the electronic device 10 utilizing various circuitry of the electronic device 10. For example, the processor core complex 12 may provide the driver IC 68 with the image data 52, and the driver IC may estimate a change in threshold voltage associated with the image data 52, modify the image data 52, and cause the modified image data 52 to be programmed onto the pixels 66 of the electronic display 18. Additionally, other circuitry that may be included in the electronic display 18 may also be utilized in performing the process 150. For instance, circuitry that is not utilized to display image data 52 may be utilized to perform portions of the process 150. FIGS. 13-21 are discussed below to elaborate to provide examples of how such circuitry may be utilized during performance of the process 150.

Figure 13:
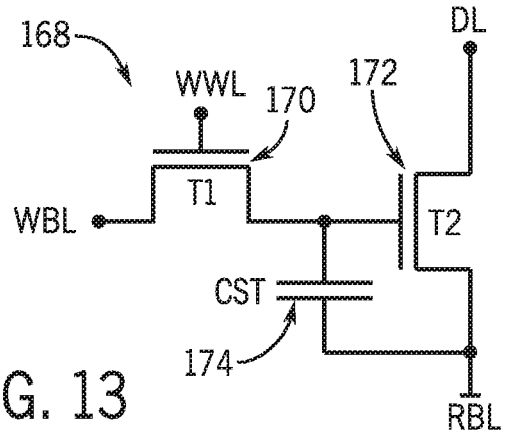
FIG. 13 is a schematic diagram of an analog multiplication unit that may be included in the electronic display of the electronic device of FIG. 1, in accordance with an embodiment.
Figure 14A:
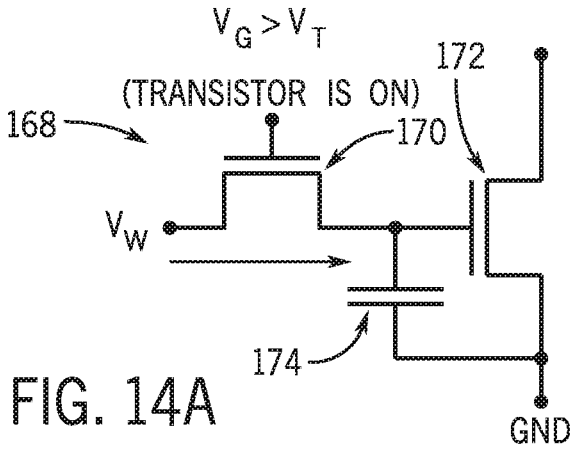
FIG. 14A is a schematic diagram of the analog multiplication unit of FIG. 13 during a write operation, in accordance with an embodiment.

FIG. 13 illustrates an analog multiplication unit 168 that may be included in the electronic display 18 and utilized during performance of the process 150. As illustrated the analog multiplication unit 168 includes a first transistor (T1) 170, a second transistor (T2) 172, and a capacitor 174. The first transistor 170 may be a low leakage transistor such as an indium gallium zinc oxide thin film transistor (IGZO TFT) or a mechanical switch. A gate-source voltage (VG) may be applied via a write word line (WWL). When the gate-source voltage is greater than a threshold voltage of the first transistor 170, a voltage provided via write bit line (WBL) may be provided to, and stored in, the capacitor 174. For example, FIG. 14A illustrates the analog multiplication unit 168 during a write operation in which a voltage $V_W$ is provided to the capacitor 174.

Figure 14B:
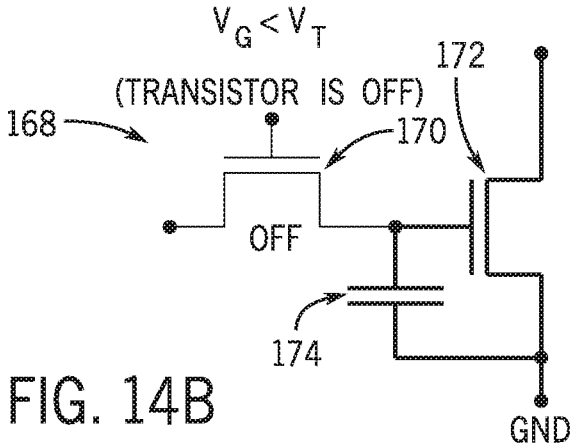
FIG. 14B is a schematic diagram of the analog multiplication unit of FIG. 13 during a hold operation, in accordance with an embodiment.

FIG. 14B illustrates the analog multiplication unit 168 of FIG. 13 during a hold operation. During the hold operation, the gate-source voltage is less than the threshold voltage and the voltage provided via the write word line (e.g., $V_W$) is held, or stored, by the capacitor 174. When the first transistor 170 is a low leakage transistor, the voltage $V_W$ may be stored on the capacitor 174 in a non-volatile manner due to the low leakage of the first transistor 170. Furthermore, a resistance of the second transistor 172 may be programmed based on the voltage $V_W$.

Figure 14C:
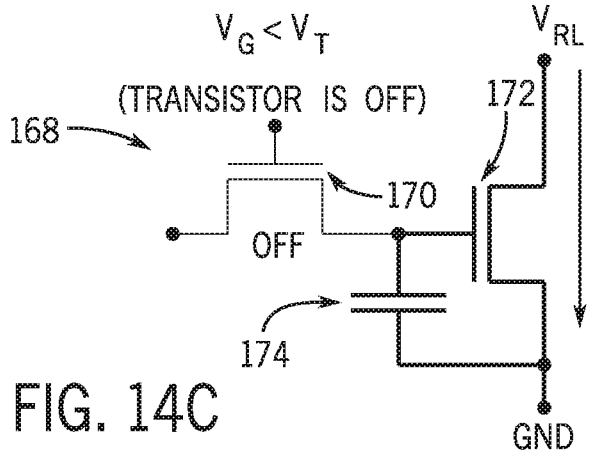
FIG. 14C is a schematic diagram of the analog multiplication unit of FIG. 13 during read operation, in accordance with an embodiment.

FIG. 14C illustrates the analog multiplication unit 168 during a read operation in which a read voltage $V_{RL}$ is applied to a data line (DL) to read the voltage stored by the capacitor 174. In particular, by applying the read voltage $V_{RL}$, the voltage $V_W$ stored by the capacitor 174 may be provided as a current.

Figure 15:
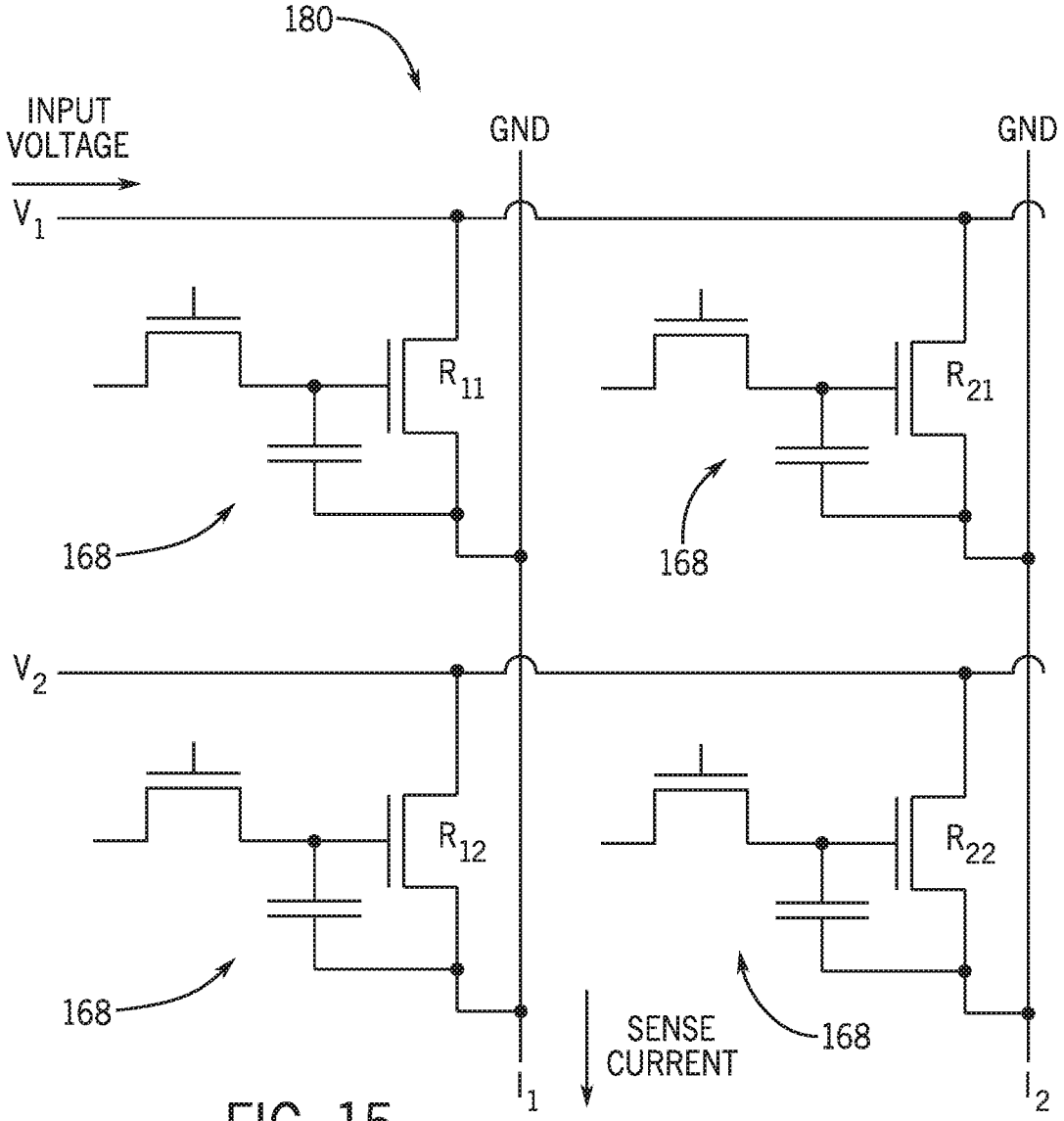
FIG. 15 is a schematic diagram a matrix multiplication unit that may be utilized to perform matrix multiplication, in accordance with an embodiment.

In some embodiments, the model may utilize matrices. That is, to perform the operations discussed above with respect to FIG. 11 and FIG. 12, matrices may be used. Groups of analog multiplication unit 168 of the electronic display 18 may be used to perform mathematical operations associated with the matrices, such as multiplication of matrixes. As an example, FIG. 15 illustrates a matrix multiplication unit 180 that includes several analog multiplication units 168 utilized to perform matrix multiplication. Resistances (e.g., $R_{11}$, $R_{12}$, $R_{21}$, $R_{22}$) may be programmed as discussed above with relation to FIG. 14B, and input voltages (e.g., $V_1$, $V_2$) may be provided, resulting in currents $I_1$ and $I_2$. Current $I_1$ would be equal to the sum of $V_1$ divided by $R_{11}$ and $V_2$ divided by $R_{12}$, current $I_2$ would be equal to the sum of $V_1$ divided by $R_{21}$ and $V_2$ divided by $R_{22}$. This operation may also be described using Equation 1 below. The currents $I_1$ and $I_2$ may be provided to a current-to-voltage converter (e.g., a transimpedance amplifier) to produce corresponding voltage which may be provided to the ADC 86 to be converted to digital signals that may utilized by the driver IC 68 (or other processing circuitry such as the processor core complex 12 or image data generation and processing circuitry 50) to determine the threshold voltage associated with a frame of image data 52 to be displayed.

$$\begin{bmatrix} I_1 \\ I_2 \end{bmatrix} = \begin{bmatrix} 1/R_{11} & 1/R_{12} \\ 1/R_{21} & 1/R_{22} \end{bmatrix} \begin{bmatrix} V_1 \\ V_2 \end{bmatrix} \quad \text{Equation 1}$$

Figure 16:
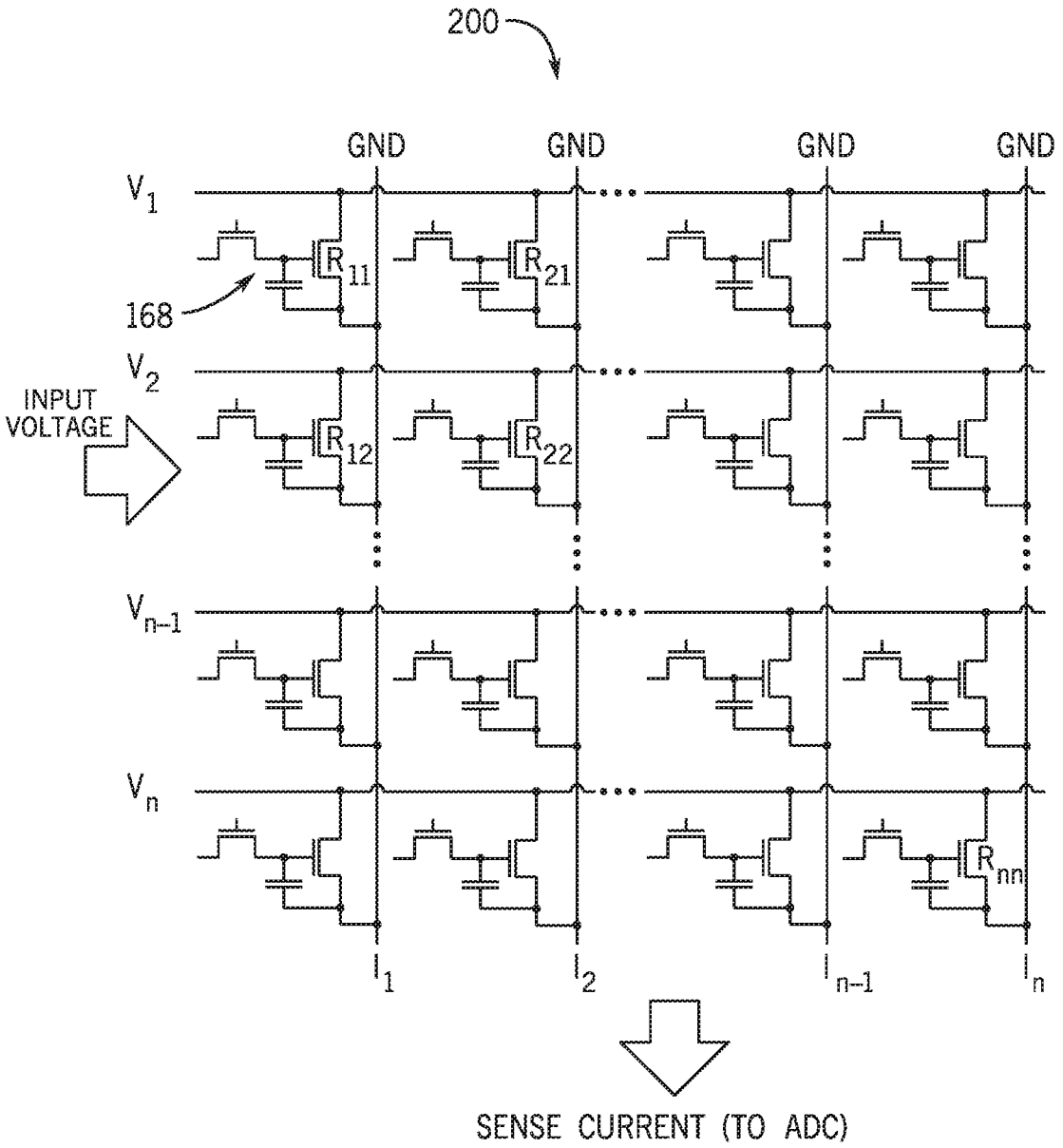
FIG. 16 is a schematic diagram of another matrix multiplication unit that may be utilized to perform matrix multiplication, in accordance with an embodiment.

While FIG. 15 illustrates a 2×2 matrix multiplication unit, in other embodiments, different amounts of analog multiplication units 168 may be used. For example, FIG. 16 illustrates another matrix multiplication unit 200 that may be utilized to perform operations involving matrices, such as multiplication. As illustrated, the matrix multiplication unit 200 is a 4×4 analog multiplication units 200. In general, an n×n matrix multiplication unit 200 may be utilized to perform matrix math operations, such as multiplication, for matrices having n or fewer rows and n or fewer columns. Additionally, in other embodiments of matrix multiplication units (e.g., other embodiments of matrix multiplication unit 180, matrix multiplication unit 200, matrix multiplication units discussed below) may be m×n matrix multiplication units having m analog multiplication units 168 per row and n analog multiplication units per column, where m and n are integers greater than zero. In such embodiments, m and n may equal to one another or different from one another.

Figure 17:
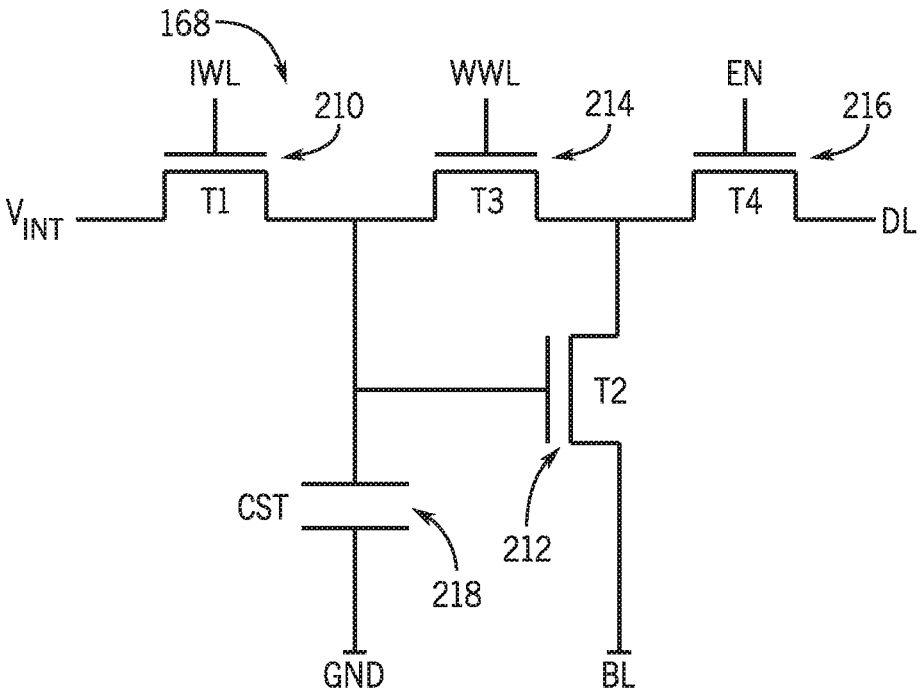
FIG. 17 is a schematic diagram of another analog multiplication unit that may be included in the electronic display of the electronic device of FIG. 1, in accordance with an embodiment.

Continuing with the drawings and the discussion of utilizing the analog multiplication units 168 of the electronic display 18 to perform mathematical operations involving matrices, FIG. 17 illustrates another embodiment of the analog multiplication unit 168 that may be included in the electronic display 18. For example, the illustrated analog multiplication units 168 may be included in a portion of the electronic display 18 that is not utilized to display content (e.g., outside of the active area 64). As illustrated, the analog multiplication unit 168 includes a first transistor (T1) 210, second transistor (T2) 212, third transistor 214 (T3), fourth transistor (T4) 216, and capacitor 218. Each of the transistors 210, 212, 214, 216 may be low leakage transistors or switches, such as IGZO TFTs. In some embodiments, only one or both of the first transistor 210 and the third transistor 214 may be a low leakage transistor or switch.

Figure 18A:
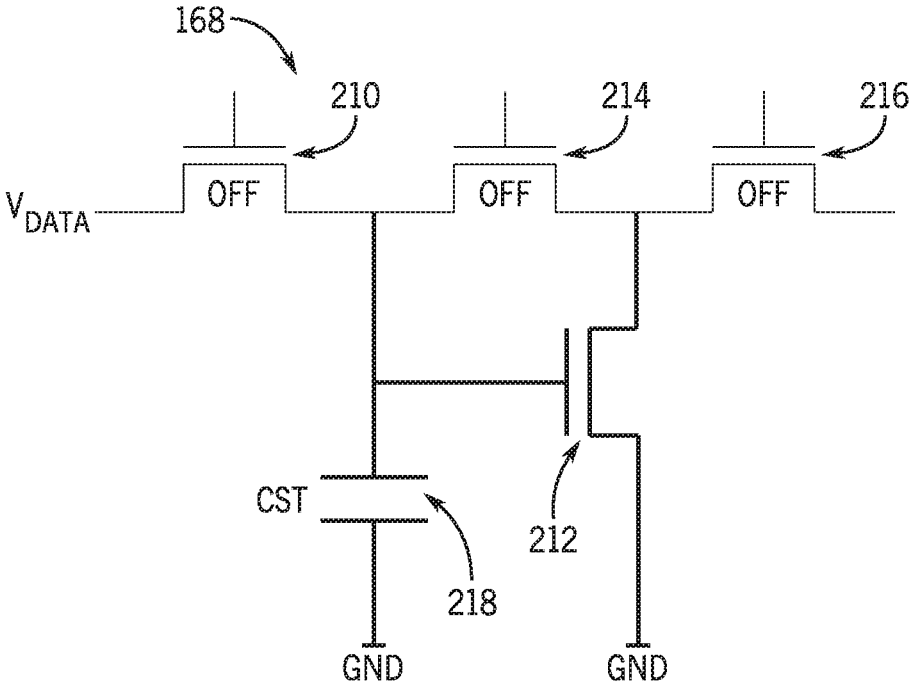
FIG. 18A is a schematic diagram of the analog multiplication unit of FIG. 17 during a hold operation, in accordance with an embodiment.
Figure 18B:
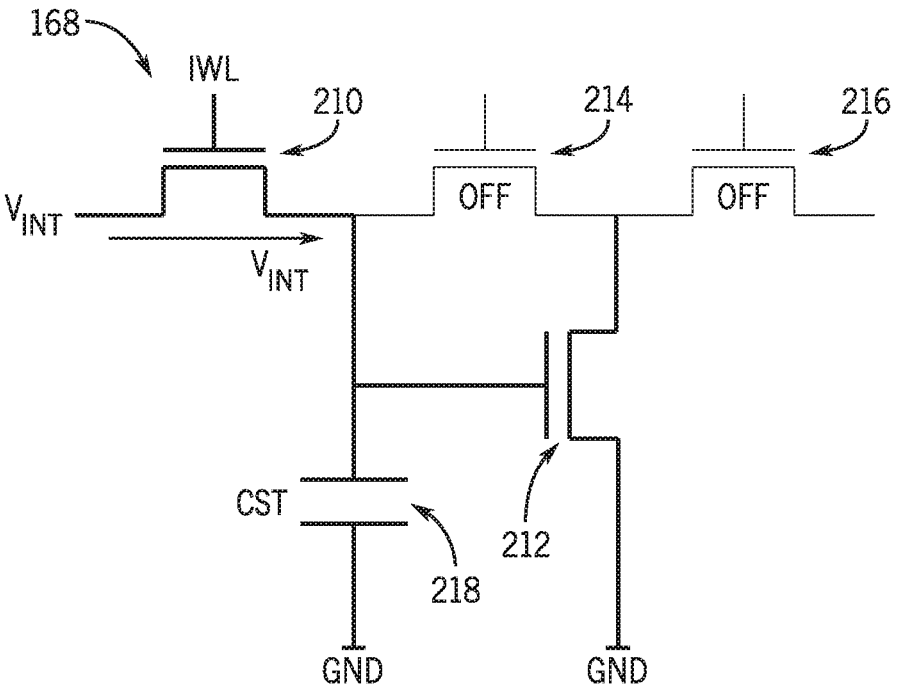
FIG. 18B is a schematic diagram of the analog multiplication unit of FIG. 17 during an initialization process, in accordance with an embodiment.

Regarding operation of the analog multiplication unit 168, the FIG. 18A illustrates the analog multiplication unit 168 during a hold operation in which a charge stored on the capacitor 218 is maintained. FIG. 18B illustrates the analog multiplication unit 168 during an initialization process during which the first transistor 210 is turned on (e.g., a voltage is supplied via the initialization word line (IWL) that is equal to or greater than a threshold voltage of the first transistor 210) and an initialization voltage $V_{INT}$ is written to the capacitor 218.

Figure 18C:
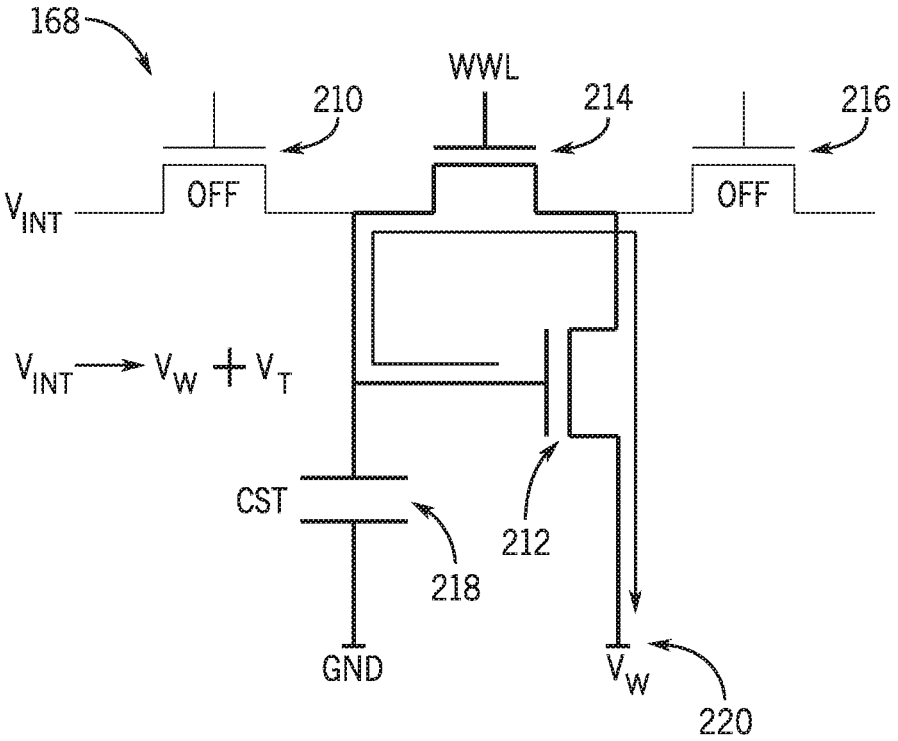
FIG. 18C is a schematic diagram of the analog multiplication unit of FIG. 17 during a threshold voltage cancelation operation, in accordance with an embodiment.

FIG. 18C illustrates the analog multiplication unit 168 during a threshold voltage cancelation operation during which the first transistor 210 is turned off and the third transistor 214 is turned on. A write voltage $V_W$ may be applied to a bit line 220 (e.g., BL of shown in FIG. 17). The write voltage may be less than $V_{INT}$. Due to the diode connection, the capacitor 218 discharges from $V_{INT}$ to a voltage equal to the sum of $V_{INT}$ and a threshold voltage $V_T$ of the second transistor 212, and that sum may be less than $V_{INT}$ but greater than $V_W$.

Figure 18D:
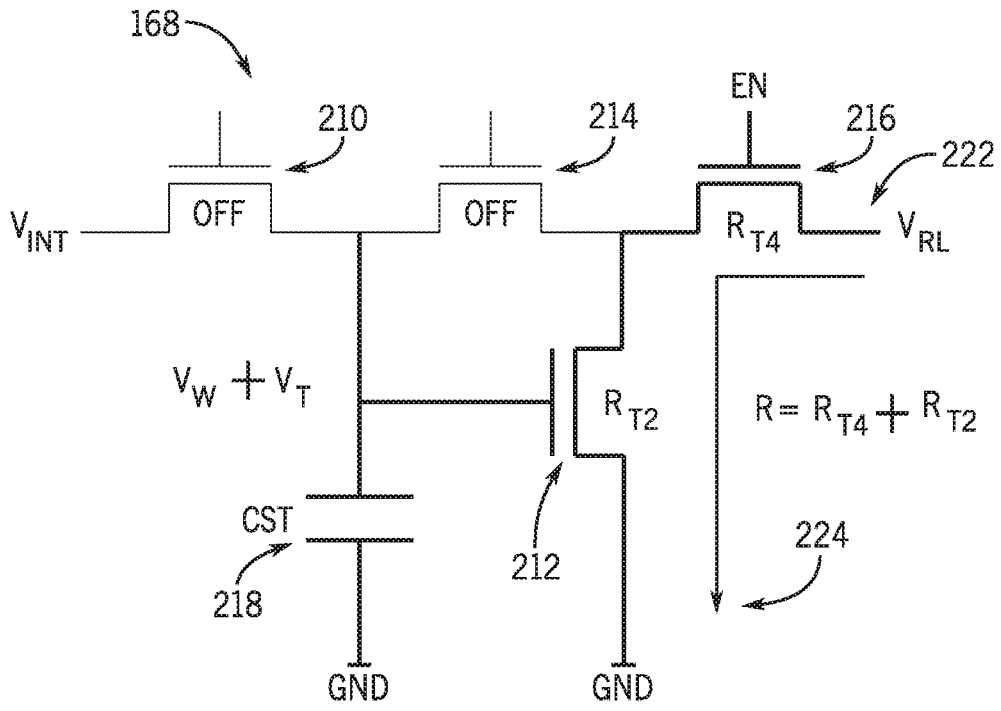
FIG. 18D is a schematic diagram of the analog multiplication unit of FIG. 17 during a read operation, in accordance with an embodiment.

FIG. 18D illustrates the analog multiplication unit 168 during a read operation in which the third transistor 214 is turned off and the fourth transistor 216 is turned on. A read voltage $V_{RL}$ 222 may be applied to a data line (e.g., DL of analog multiplication unit 168 in FIG. 17). The resulting current illustrated by line 224 may be equal to $V_{RL}$ divided by the sum of a resistance R4 associated with the fourth transistor 216 and a resistance R2 associated with the second transistor 212.

Figure 19:
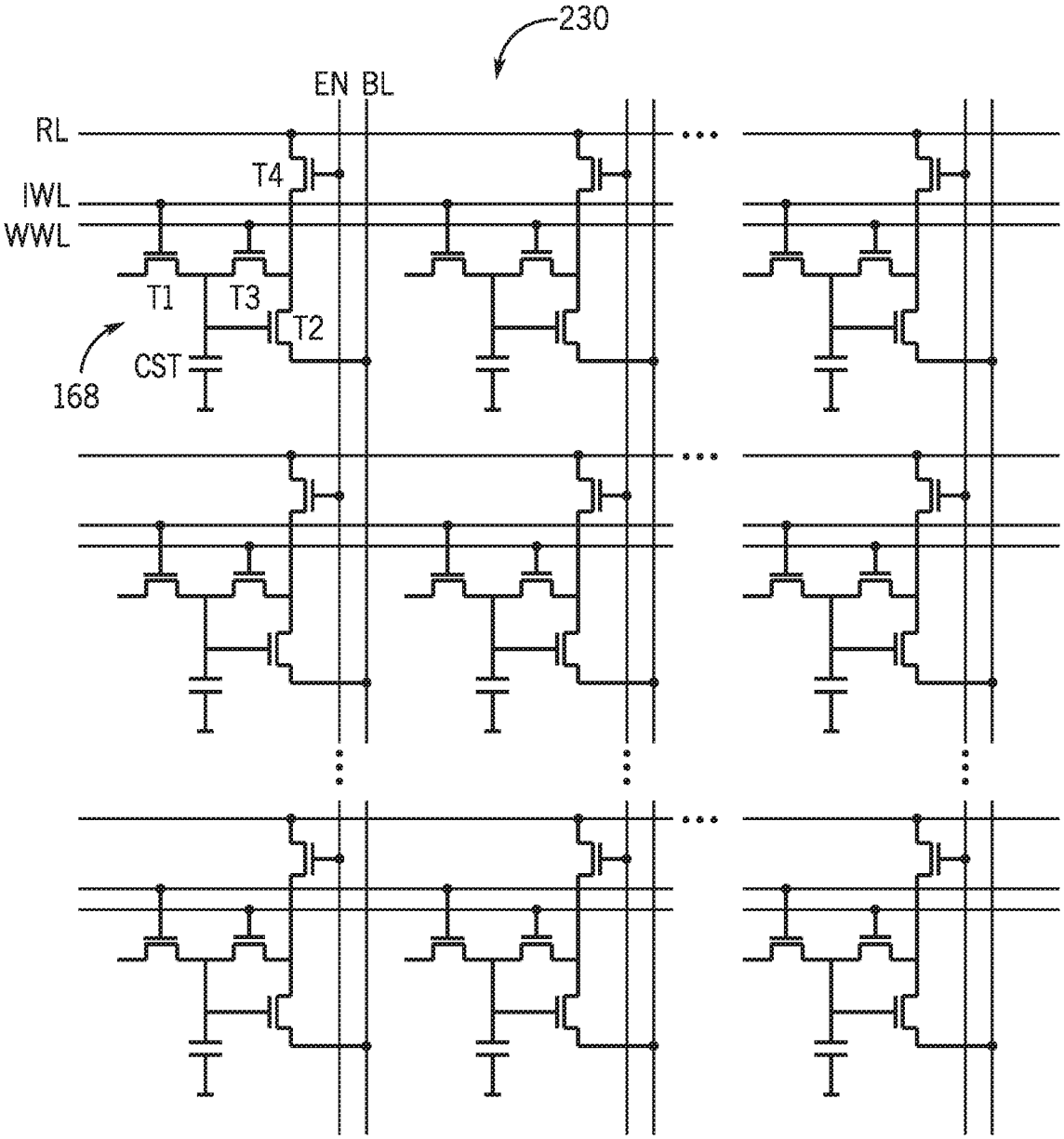
FIG. 19 is a schematic diagram of another matrix multiplication unit, in accordance with an embodiment.
Figure 20:
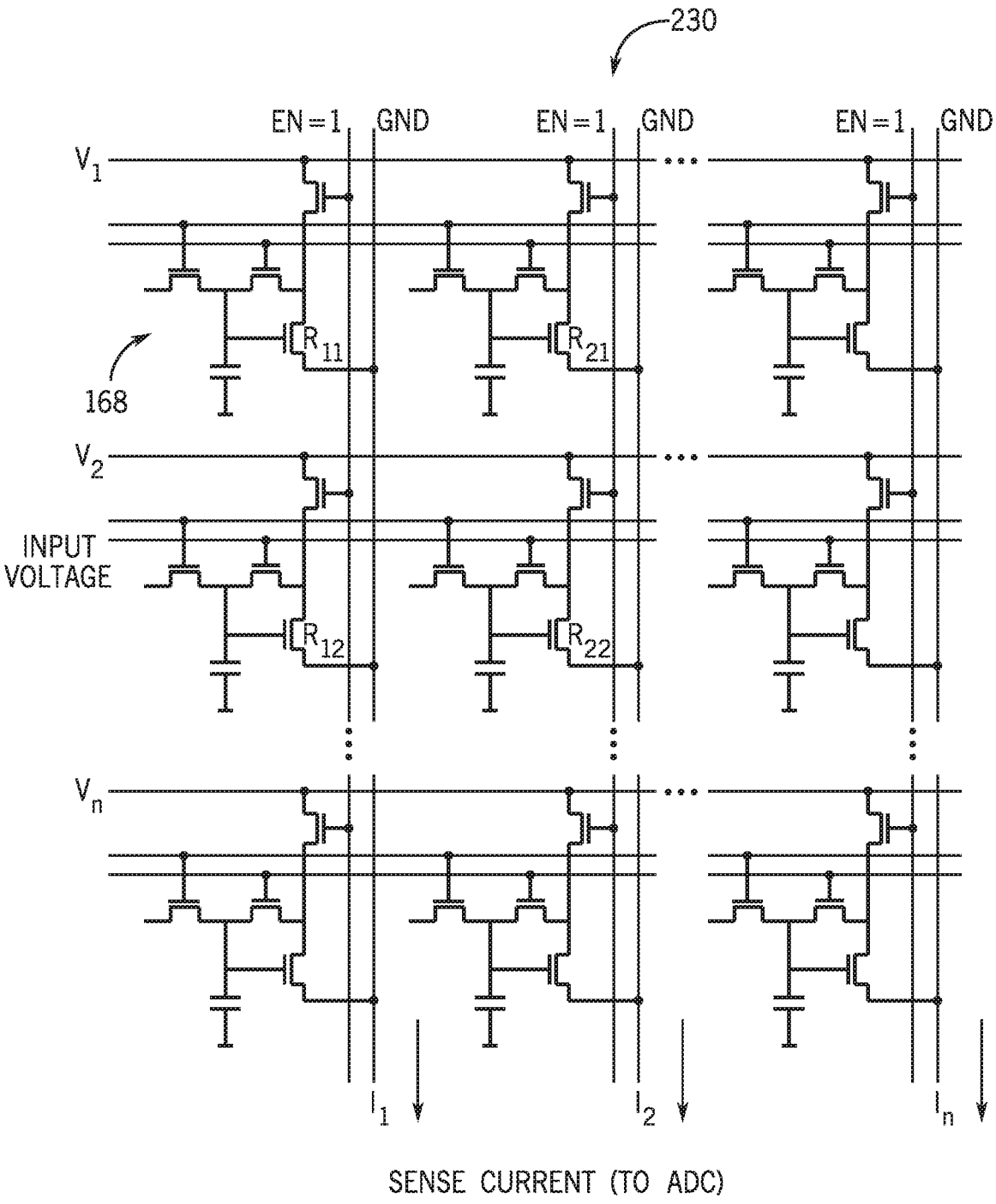
FIG. 20 is a schematic diagram of the matrix multiplication unit of FIG. 19 during a read operation, in accordance with an embodiment.

Similar to the embodiment of the analog multiplication unit 168 discussed with respect to FIG. 13, the embodiment of the analog multiplication unit 168 depicted in FIG. 17 may also be included in matrix multiplication units included in the electronic display 18. For example, FIG. 19 illustrates a matrix multiplication unit 230 of analog multiplication units 168. As depicted, the matrix multiplication unit 230 may include many rows and columns of analog multiplication units 168. In general, an m×n matrix multiplication unit 230 may be utilized to perform matrix math operations, such as multiplication, for matrices having m or fewer analog multiplication units 168 per row and n or fewer analog multiplication units 168 per column, where m and n are integers greater than zero that may be equal or different from one another. FIG. 20 depicts the matrix multiplication unit 230 during a read operation during which voltages are applied along voltage lines (e.g., $V_1$, $V_2$, $V_n$) as well as EN lines. The resulting currents (e.g., currents $I_1$, $I_2$, $I_n$) may be provided to the ADC 86 of the driver IC 68 and utilized to modify image data 52 for the subsequent frame of the image data 52.

Figure 21:
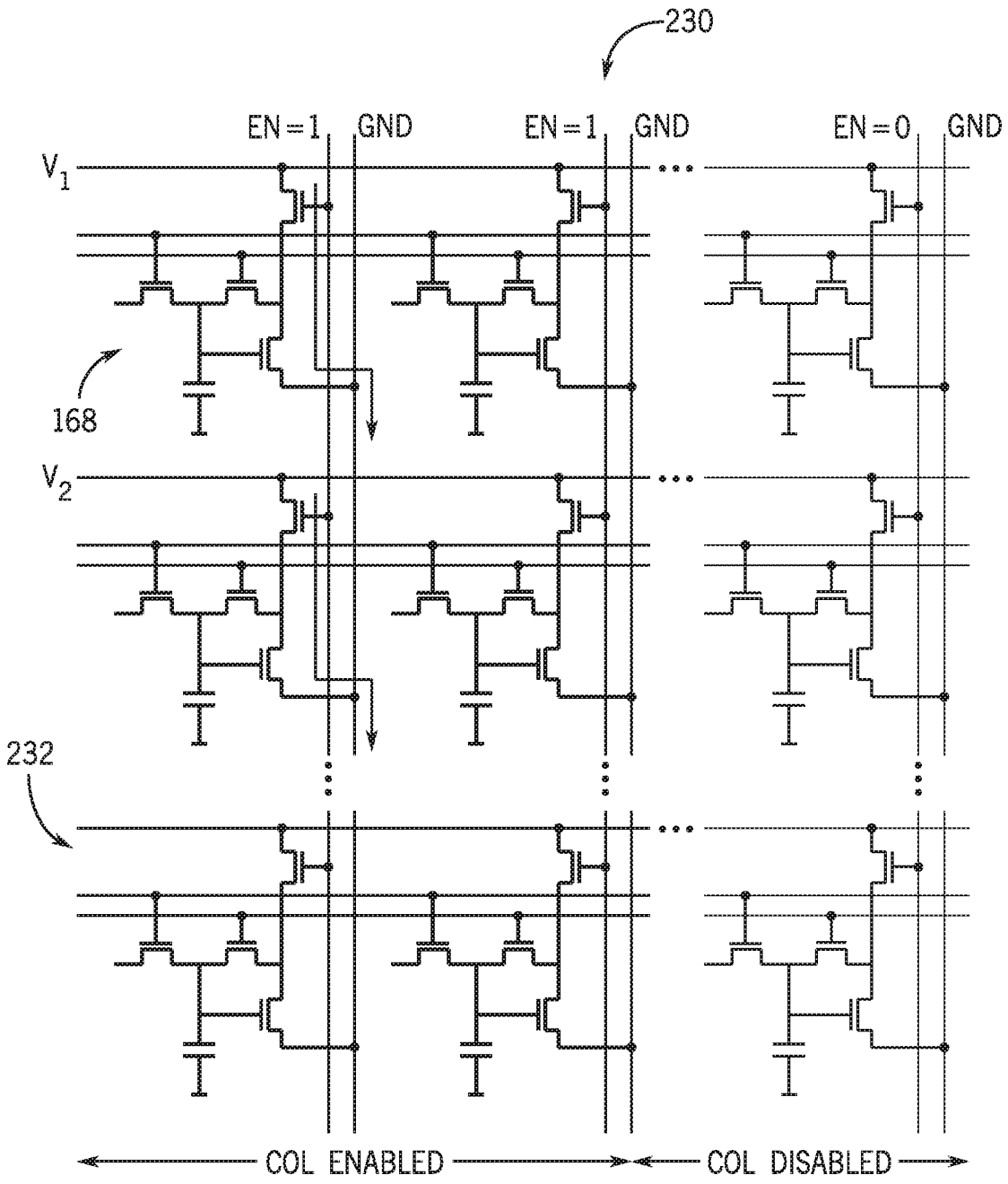
FIG. 21 is a schematic diagram of the matrix multiplication unit of FIG. 19 when only two columns of pixels are being utilized, in accordance with an embodiment.

Furthermore, it should be noted that the numbers of columns and rows of analog multiplication units 168 utilized may be modifiable by selectively utilizing voltage lines and/or EN lines. For example, as depicted in FIG. 21, two columns of analog multiplication units 168 are utilized (e.g., columns with EN=1) while another column of analog multiplication units 168 is not utilized (e.g., column with EN=0). Similarly, fewer rows of analog multiplication units 168 could be utilized by only applying voltages to fewer than all of the voltage lines of the matrix multiplication unit 230. For instance, voltages $V_1$ and $V_2$ may be applied to utilize two rows of analog multiplication units 168, while no voltage may be applied to voltage line 232.

While the discussion above relating to FIGS. 13-21 is provided to demonstrate several examples of pixel circuitry and how the pixel circuitry may be utilized to perform portions of the process 150, it should be noted that these operations (e.g., calculations that are performed) may be performed in any other suitable manner. For example, processing circuitry such as the processor core complex 12, the image data generation and processing circuitry 50, processing circuitry included in the driver IC 68, or a combination thereof may be utilized. Additionally, data that may be stored on the capacitors (e.g., capacitor 174 or capacitor 218) of the analog multiplication units 168 may be stored alternatively, such as in the local memory 14 or memory associated with the electronic display 18.

Additionally, while the model is discussed above as being utilized to modify the image data 52 for each pixel 66 based on a predicted change in threshold voltage associated with each pixel 66 of the electronic display 18, it should be noted that the model may be utilized differently in other embodiments. For example, image data 52 to be displayed in various portions of the display (e.g., groups of pixels 66) may be compensated based on predicted changes in threshold voltage associated with one or several of the pixels 66 included in the groups of pixels 66. That is, while a change in threshold voltage associated with each pixel 66 can be predicted and the image data 52 associated with each pixel can be modified based on the predicted change in threshold voltage, the electronic device 10 may predict changes in threshold voltage(s) for a subset of the pixels 66 of the electronic display 18 and compensate the image data 52 for the subset of pixels 66, as well as pixels grouped with the subset of pixels, based on the predicted change in the threshold voltage(s) of the subset of pixels.

Determining Device Parameters Utilized to Estimate Changes in Threshold Voltage for Image Data to be Displayed As discussed above, a threshold voltage for a subsequent frame of image data 52 may be determined based on a voltage associated with a current frame of content, a constant (e.g., $\tau$), a rate of trapping/detrapping, a frame rate associated with the image data 52, and/or device parameters. As additionally noted above, the device parameters may include changes in voltage (e.g., values of $\Delta V$) associated with each time constant for each gray level.

Referring briefly back to FIG. 9, the graph 100 provides exponential decay functions showing changes in voltage over time. These functions (e.g., represented by lines 102, 104, 106) represent TFT hysteresis (e.g., hysteresis of TFT 82) for various time constants $\tau$, which the model discussed above accounts for (e.g., by predicted a change in threshold voltage of the driver TFT 82 and modifying the image data 52 based on the predicted change in threshold voltage). In other words, each of the lines 102, 104, 106 illustrates changes in threshold voltage over time associated with different time constants related to trapping and detrapping occurring at various rates (e.g., a first trap for a relatively fast rate (e.g., associated with $20\tau$), a second trap for a relatively intermediate rate (e.g., associated with $\tau$), and a third trap for a relatively slow rate (e.g., associated with $0.05\tau$)). The graph 120 provides the line 122 that is indicative of the sum of the lines 102, 104, 106. Thus, the line 122 accounts for several different rates at which trapping and detrapping occurs.

Figure 22:
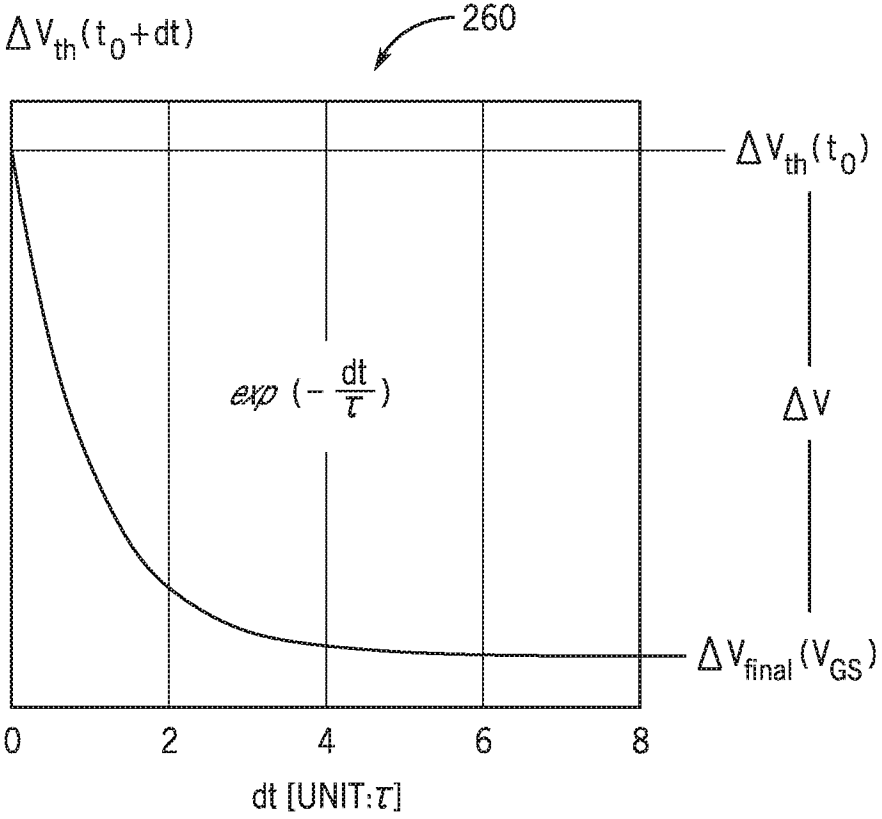
FIG. 22 illustrates a graph that shows change in threshold voltage over time for a single trap in which charge trapping and detrapping occurs at a rate defined as a function of a time constant $\tau$ associated with the trap, in accordance with an embodiment.

To help elaborate on rates of charge trapping and detrapping, FIG. 22 is provided. FIG. 22 illustrates graph 260, which shows change in threshold voltage ($V_{th}$) over time for a single trap in which charge trapping and detrapping occurs at a rate defined as a function of the time constant $\tau$ associated with the trap. More specifically, the graph 260 illustrates a function of a rate at which trapping and detrapping occurs, which is provided below as equation 2:

$$P = e^{\left(-\frac{dt}{\tau}\right)} \qquad \text{Equation 2}$$

Where P is the rate of trapping and detrapping, dt is a change in time, and $\tau$ is the time constant. Over time, charge trapping and detrapping may cause shifts in threshold voltage as time increases. For example, as the value of dt increases, a final voltage, such as a gate-source voltage associated with the driver TFT 82 for a particular gray level, may decrease by an amount $\Delta V_{final}$ due to a shift in threshold voltage associated with the driver TFT 82. It should be noted that, in other embodiments, the rate of trapping and detrapping may be defined using an equation other than Equation 2.

Keeping the discussion of the graph 260 in mind, one example of how the model may predict a change in threshold voltage will now be discussed. For a given trap after an amount of time dt has passed since a starting time $t_0$, the change in threshold voltage associated with the trap may be estimated using Equation 3:

$$\Delta V_{th}(t_0+dt) \cong \Delta V_{final}(V_{GS}) - P(\Delta V_{final}(V_{GS}) - \Delta V_{th}(t_0)) \qquad \text{Equation 3}$$

where $\Delta V_{th}(t_0+dt)$ is the estimated threshold voltage after the amount of time dt has passed, $\Delta V_{final}(V_{GS})$ is 1 a final voltage associated with gate-source voltage associated with the driver TFT 82 for a particular gray level (e.g., a voltage for a relatively large value of dt), P is the rate of trapping and detrapping, and $\Delta V_{th}(t_0)$ is the change in threshold voltage associated with the starting time to. In some embodiments, dt may be equal to an amount of time associated with a frame rate of the image data 52 (e.g., approximately 16.67 milliseconds for a frame rate 60 FPS). For an embodiment of the model utilizing multiple traps, Equation 3 may be performed to predict a change in threshold voltage for each trap, for instance, because each trap included in the model may be associated with a different time constant, each trap may have a different change in threshold voltage. As discussed above with respect to FIG. 10, the predicted changes in threshold voltage for each trap may be summed to obtain the predicted change in the threshold voltage associated with image data 52. Accordingly, many time constants $\tau$ (which may be included in P as provided by Equation 2) and $\Delta V_{final}(V_{GS})$ associated with each time constant may be associated with each gray level (e.g., G0-G255).

Figure 23:
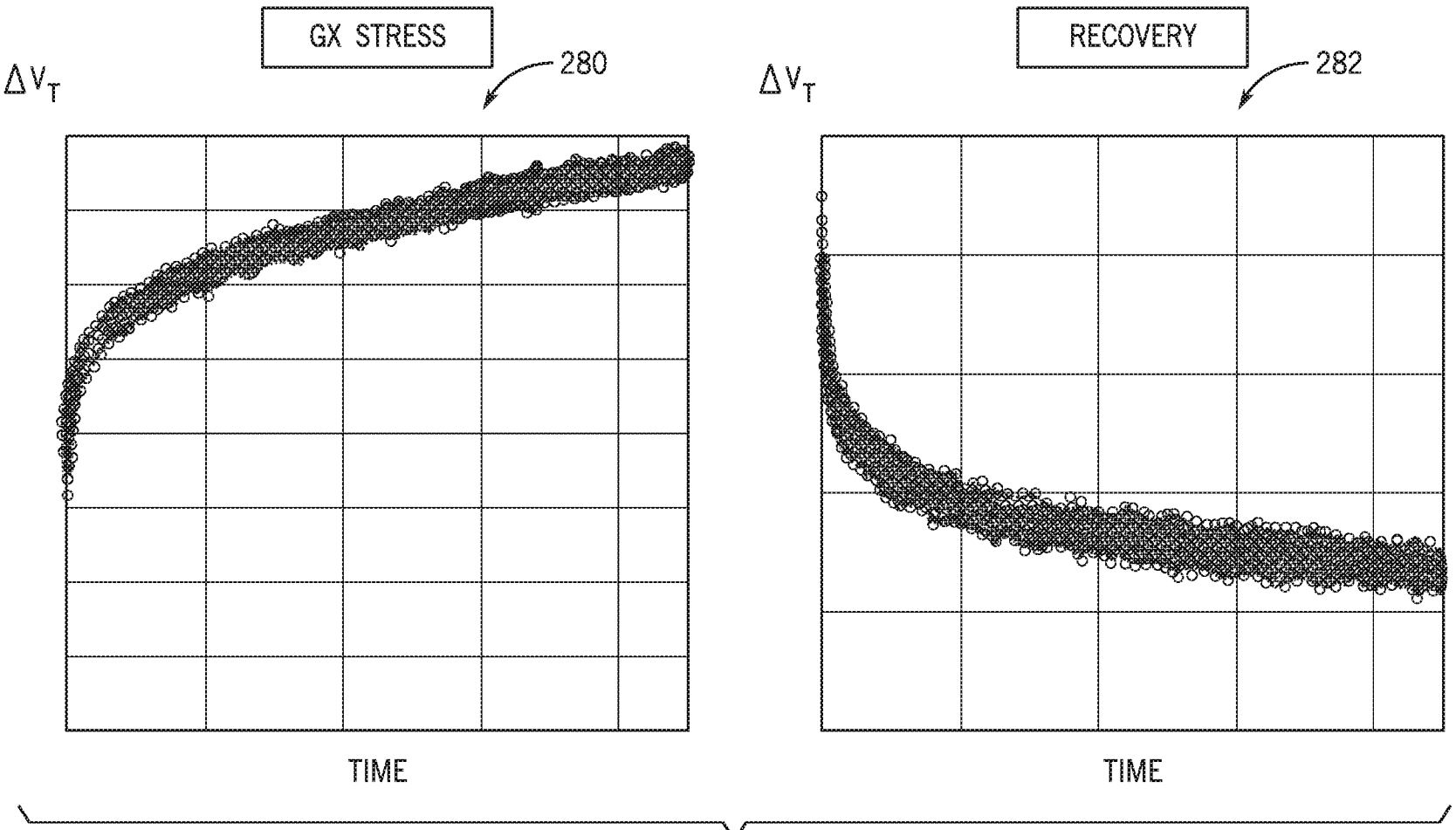
FIG. 23 illustrates a first graph showing a change in threshold voltage for a transistor over time when a voltage is applied to the transistor and a second graph showing a change in threshold voltage over time during a threshold voltage recovery period, in accordance with an embodiment.

Bearing this in mind, how the time constants and final voltages may be determined for each gray level will now be discussed. Generally speaking, these values may be obtained using data associated with changes in voltage over time (e.g., threshold voltage of the driver TFT 82) associated with the gray level. For example, FIG. 23 illustrates graph 280 and graph 282. In particular, the graph 280 illustrates change in threshold voltage (e.g., of the driver TFT 82) over time when a voltage is applied to the driver TFT 82. For example, the voltage may be a voltage associated with a particular gray level (e.g., a particular pixel brightness). As illustrated, as time passes, the threshold voltage increases. The graph 282 illustrates a change in threshold voltage over time during a threshold voltage recovery period. For example, the threshold voltage recovery period may correspond to a time when a different voltage is applied to the driver TFT 82. For example, the voltage may be a voltage associated with a different gray level that is used as a standard. The standard gray level may be a gray level for which the stress voltage (e.g., voltage applied to collect data shown in graph 280) is zero volts. By measuring the changes in voltage from when one gray level is applied to when the standard voltage is applied and from when the standard voltage is applied to a later period of time, the device parameters (e.g., time constants and corresponding final voltages) associated with each gray level (e.g., G0-G255) may be determined.

Figure 24:
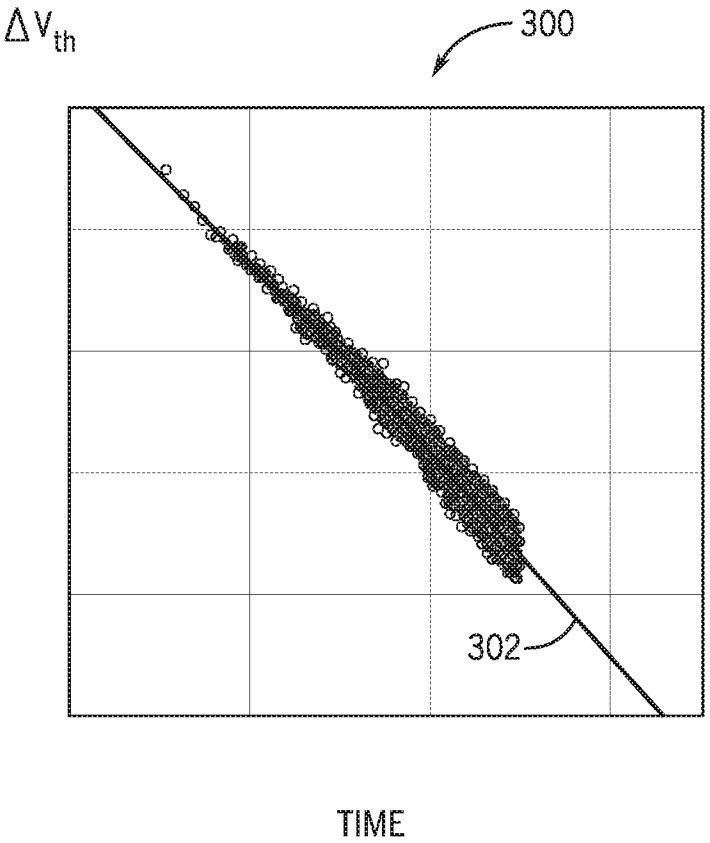
FIG. 24 illustrates a graph showing recovery in threshold voltage for a transistor of a pixel of the electronic display of FIG. 7 associated with a transition from a first gray level to a second gray level, in accordance with an embodiment.

With this in mind, FIG. 24 illustrates a graph 300 showing threshold voltage over time. More particularly, the graph 300 illustrates recovery in threshold voltage for a TFT 82 from a first gray level to a second gray level, such as a standard gray level as discussed above. A line 302, such as a line of best fit, may be obtained based on the individual data points depicted in the graph 300.

Figure 25:
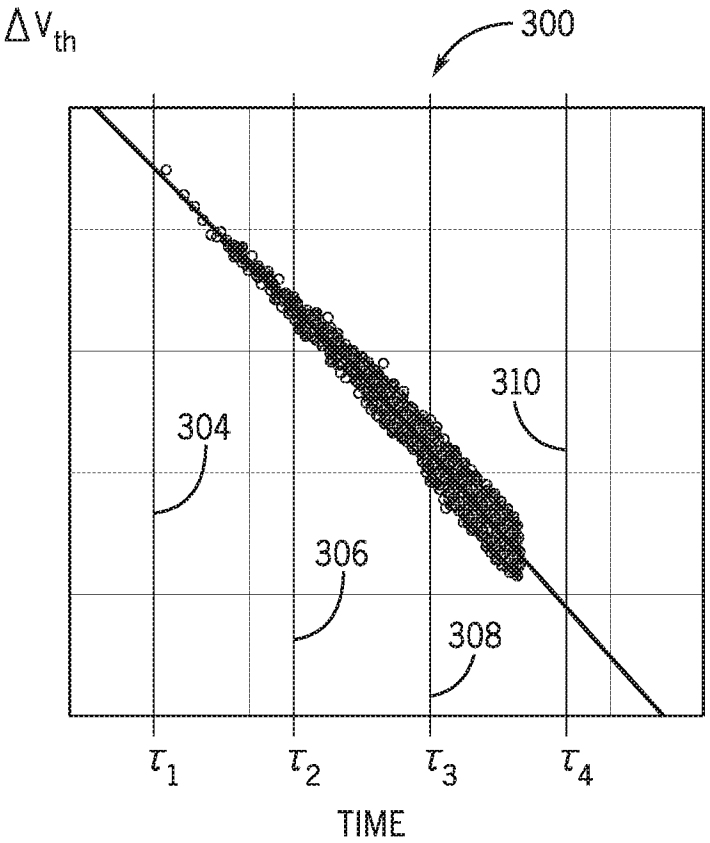
FIG. 25 illustrates the graph of FIG. 24 with time constants included, in accordance with an embodiment.

FIG. 25 depicts the graph 300 after time constants have been added to the graph 300. For instance, lines 304, 306, 308, 310 represent amounts of time (e.g., in seconds) associated with different time constants. In some embodiments, the time constants may be time constants associated with the second gray level (e.g., the gray level to which a transition occurs). In particular, a first time constant (e.g., associated with line 304) may be assigned to a first data point, and subsequent time constants may be assigned based on a bin size associated with the collected data and the first time constant.

Figure 26:
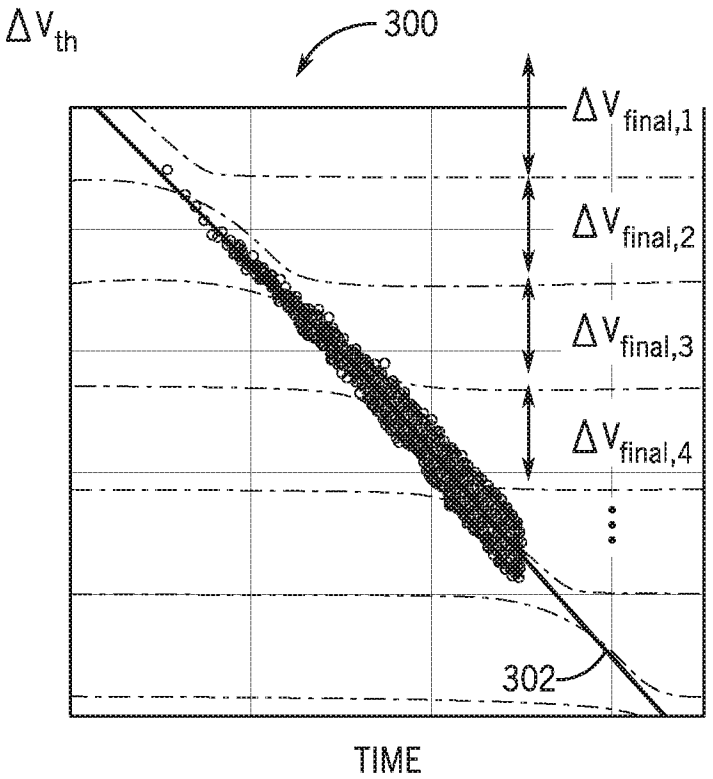
FIG. 26 illustrates the graph of FIG. 24 in which final changes in voltage are included, in accordance with an embodiment.

FIG. 26 depicts the graph 300 with final changes in voltage ($\Delta V_{final}$) labeled. The final changes in voltage, which may be referred to as final voltages, are the final changes in voltage is associated with a time constant for a particular gray level. For example, the final voltages may be associated with a gray level GX, where X is an integer between 0 and 255, inclusive. It should be noted that the values of $\Delta V_{final}$ may be modified to improve the fit of the line 302. For example, for time equals zero, the threshold voltage (e.g., as represented via the line 302) may be set equal to a threshold voltage or change in threshold voltage obtained by collecting data as discussed above with respect to the graph 280 of FIG. 23.

Figure 27:
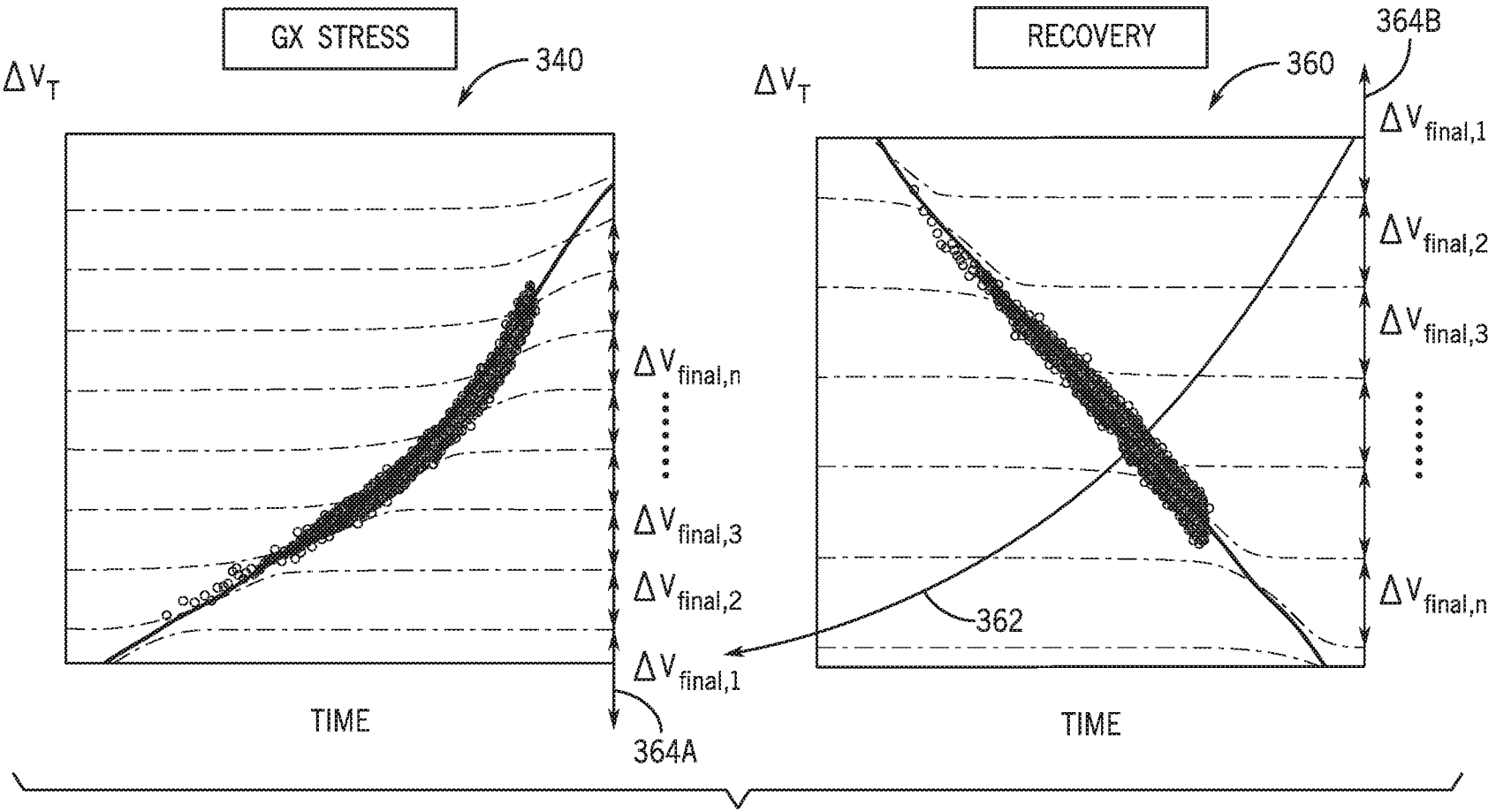
FIG. 27 depicts a graph showing change in threshold voltage over time while a voltage associated with a gray level is applied as well as values of $\Delta V_{final}$ associated with different time constants, in accordance with an embodiment.

Fitting of the line 302 may be done to account for conservation of change for a transition in gray level. For example, for a transition from a first gray level to a second gray level (e.g., GX) to the first gray level, each change in threshold voltage associated with each time constant may be equal to one another. FIG. 27 depicts a graph 340 showing change in threshold voltage while a voltage associated with the second gray level (e.g., GX) is applied over time as well as values of $\Delta V_{final}$ associated with different time constants. FIG. 27 also includes a graph 360, which shows change in threshold voltage while a first voltage (e.g., voltage associated with a standard gray level) is applied as well as the values of $\Delta V_{final}$ associated with different time constants. As shown by line 362, a final voltage 364A associated with the graph 340 is equal or approximately equal to a final voltage 364B associated with the graph 360.

Figure 28:
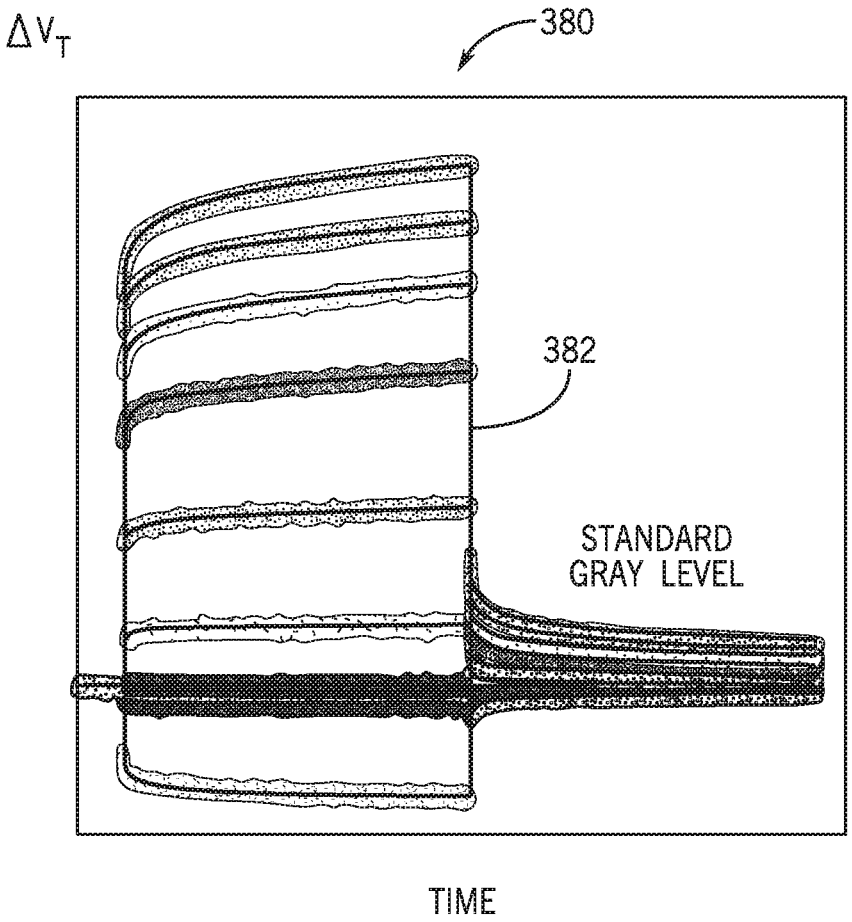
FIG. 28 is a graph depicting change in threshold voltage over time for several gray levels, in accordance with an embodiment.

Using the techniques described with respect to FIGS. 24-27, the time constants and final voltages (e.g., values of $\Delta V_{final}$ associated with each time constant) may be obtained for each gray level. FIG. 28 includes a graph 380 depicting change in threshold voltage over time for several gray levels. Data to the left of line 382 is associated with when voltages (e.g., stress voltages) associated with particular gray levels are applied, whereas the data to the right of the line 382 shows the recovery in threshold voltage associated with when a voltage associated with the standard gray level is applied.

The device parameters, such as the time constants and final voltages, associated with each gray level may be stored on the electronic device 10 and utilized by the electronic device 10 to determine the change in threshold voltage associated with the image data 52 for a frame of content to be displayed. FIG. 29 depicts a table 400 of device of parameters that may be stored in the local memory 14, storage 16, or memory that may be included in the electronic device 10, such as memory of the image data generation and processing circuitry 50, the electronic display 18, components of the electronic display 18 (e.g., included in memory associated with the driver IC 68), or a combination thereof. The table 400 includes a first column 402 of gray levels that may include each gray level (e.g., G0-G255). The table also includes columns 404 and 406, which respectively indicate values of time constants and corresponding final voltages associated with the gray levels of the first column 402.

When utilizing the model described herein, processing circuitry such as the processor core complex 12, image data generation and processing circuitry 50, and the driver IC 68 may utilize data included in the table 400 to implement the process 150 to estimate a change in threshold voltage associated with image data 52 to be displayed and to modify the image data 52 based on the predicted change in threshold voltage.

Selection of Time Constants

The time constants utilized while implementing the model to estimate a change in threshold voltage of the driver TFT 82 associated with image data 52 to be presented, as well as the number of time constants utilized may be variable. For example, while implementing and using the model, the electronic device 10 may use a default number of time constants (e.g., one, two, three, four five, six, seven, or more time constants). However, the electronic device 10 may determine to use more or fewer time constants based on several factors such as, but not limited to, a type of electronic device 10 (e.g., computer, phone, tablet), available processing power, battery life, applications running on electronic device, and user preferences. In either case, the electronic device 10 may select time constants associated with a gray value of image data 52 to be displayed, for example, from the table 400. In other words, the table 400 may include more time constants than the number of time constants that will be used while implementing the model to predict changes in threshold voltage. Accordingly, the electronic device 10 may select a portion of the total number of time constants to utilize. Furthermore, the electronic device 10 may change which time constants are used. For example, at a first time, the electronic device 10 may be utilizing a first subset of time constants, whereas at a different time, a second subset of time constants may be used. The second subset of time constants may include a different number of time constants and one or more of the time constants included in the first subset of time constants.

The electronic device 10 may determine which time constants to utilize based on several factors, such as the image data 52, how the electronic device 10 is being used (e.g., a mode of operation), characteristics of the driver TFTs 82, other image data compensation techniques that the electronic device 10 may perform, or a combination thereof. For example, as discussed above, each gray level may be associated with various time constants (e.g., as provided in the table 400). For a frame of image content described in the image data 52 to be displayed, the electronic device 10 may determine the time constants associated a gray level of the image data 52 for a particular pixel 66 (or group of pixels 66). From the time constants associated with the gray level, the electronic device 10 may determine a subset of the time constants based on how the electronic device 10 is being used, characteristics of the driver TFTs 82, other image data compensation techniques that the electronic device 10 may perform, or a combination thereof.

Regarding a use of the electronic device 10, in some cases, a user may be using the electronic device 10 for an activity or purpose for which preventing image sticking may be a relatively higher priority. For instance, when a user is utilizing the electronic device 10 for activities such as graphic design, editing image or video content, or viewing image or video content, preventing image sticking may be of a relatively higher priority compared to when the electronic device 10 is idle (e.g., the electronic display 18 is on but the user is not using the electronic device 10), when the electronic display 18 is off (e.g., when the electronic device 10 is in a locked mode), or when the electronic device 10 is being used to display relatively static content (e.g., displaying text such as in emails).

When preventing image sticking is a relatively higher priority, relatively smaller time constants may be utilized. For example, the time constants may be associated with units of time that are smaller than a second (e.g., various numbers of milliseconds). Conversely, when preventing image sticking may be a relatively lower priority, time constants associated with relatively larger amounts of time may be selected. For example, the time constants may be associated with several seconds, minutes, or hours.

The time constants may also be selected based on the characteristics of the driver TFTs 82 of the pixels 66 of the electronic display 18. For example, as discussed above, when a stress voltage is applied to a driver TFT 82, the threshold voltage of the driver TFT 82 may change over time (e.g., as illustrated in FIG. 23 and FIG. 28). As also discussed above, changes in threshold voltage may cause image sticking. However, in some cases, image sticking may not be perceivable to the human eye. Accordingly, the time constants may be selected based on when image sticking may begin to be perceivable to the human eye or when image sticking is perceivable to the human eye.

Time constants may also be selected based on other image data compensation techniques that the electronic device 10 may perform. For example, the electronic device 10 may perform in-pixel compensation in which image data 52 is sampled and compensated for at a relatively high speed. In such as case, the electronic device 10 may opt to select relatively time constants associated with relatively high amounts of time (e.g., many seconds, minutes, hours) because utilizing time constants associated with relatively small amounts of time would be redundant. As another example, the electronic device 10 may perform sensing to compensate image data every couple of hours or days. In this case, the electronic device 10 may determine to utilize time constants associated with relatively small amounts of time (e.g., milliseconds, seconds, minutes) because utilizing time constants associated with relatively large amounts of time would be redundant. As yet another example, the electronic device 10 may perform other compensation techniques that account for relatively small amounts of time (e.g., milliseconds or seconds) and relatively large amounts of time (e.g., hours or days). In this case, the electronic device may select time constants associated with intermediate amounts of time, such as minutes (e.g., 1 minute to 119 minutes).

Furthermore, time constants may be selected based on a combination some or each of: how the electronic device 10 is being used; characteristics of the driver TFTs 82; and other image data compensation techniques that the electronic device 10 may perform. For example, the electronic device 10 (e.g., via the processor core complex 12, image data generation and processing circuitry 50, driver IC 68, or a combination thereof) may assign weights to each of these factors and determine the time constants based on the weights.

In addition to the factors discussed above, the time constants may also be selected on other factors such as, temperature, pulse-width modulation (PWM) of image data signals, a state of a display (e.g., on or off), and a pixel's location within the electronic display 18. For instance, the electronic device 10 may utilize time constants associated with relatively smaller amounts of time when the electronic display 18 is a relatively high temperature. When the electronic display 18 has a relatively lower temperature, time constants associated with relatively greater amounts time may be selected. As another example, when the electronic display 18 is off, time constants associated with relatively higher amounts of time may be utilized relative to when the electronic display 18 is on. As yet another example, pixels 66 or groups of pixels 66 may be associated with different time constants based on their location within the electronic display 18. For instance, the electronic device 10 may select time constants associated with relatively smaller amounts of time for pixels 66 or portions of pixels 66 of the electronic display 18 where a user is more likely to gaze while using the electronic device 10, such as in a center area of the electronic display 18. Conversely, the electronic device 10 may select time constants associated with relatively larger amounts of time for pixels 66 or groups of pixels 66 found in areas of the electronic display 18 that a user may less frequently look, such as near an edge (e.g., outer border) of the electronic display 18.

As the electronic device 10 is used to display image content based on the image data 52, changes in the time constants may occur. For example, at a first time, the electronic device 10 may utilize a first subset of time constants associated a particular gray level. As the image data 52 is displayed, a certain level or pattern of image sticking may occur. At a different time, if the same image data 52 were to be utilized and a second, different subset of time constants for the same gray level were selected, a different level or pattern of image sticking may occur. For example, if the first set of time constants were to be associated with relatively small amounts of time, a pattern of image sticking may occur when the image data 52 has been displayed for relatively long periods of time. However, if the second subset of time constants associated with relatively long amounts of time were used, a pattern of image sticking may occur for portions of the image data 52 that are displayed for relatively short amounts of time.

The techniques discussed herein enable electronic device to predict content-dependent changes in threshold voltage associated with transistors of pixels of electronic displays. For instance, a predictive model may be implemented on an electronic device 10 to estimate a change in threshold voltage associated with a frame of content to be displayed based on several factors including, but not limited to, characteristics of a current frame of content (e.g., a frame of content displayed immediately before the frame of content to be displayed), characteristics of the frame of content to be displayed (e.g., a gray level associated with the content), characteristics of the electronic device 10 and the electronic display 18, and how the electronic device 10 is being used. Furthermore, pixel circuitry of the electronic display 18 may be utilized to perform operations carried out to determine an estimated change in threshold voltage. Furthermore, the model may utilize different time constants that can be selected based on several different factors discussed herein. Accordingly, by compensating image data (e.g., image data 52) for predicted changes in threshold voltage in driver TFTs 82 of the pixels 66 of the electronic display 18, image sticking and other visual artifacts that can occur due to hysteresis in the driver TFTs 82 may be reduced or eliminated.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

an electronic display comprising an active area comprising a pixel; and processing circuitry configured to:

receive image data comprising a first frame of content and a second frame of content;

predict a change in threshold voltage associated with a transistor of the pixel at least in part by estimating a change in the threshold voltage associated with the second frame of content based at least in part on a change in threshold voltage associated with the first frame of content; and adjust the image data to generate adjusted image data based at least in part on the predicted change in threshold voltage.

2. The electronic device of claim 1, wherein the processing circuitry is configured to predict the change in threshold voltage based at least in part on a plurality of time constants, wherein each time constant is associated with a different rate of charge trapping and detrapping associated with the transistor.

3. The electronic device of claim 1, wherein the processing circuitry is configured to estimate the change in threshold voltage associated with the second frame of content based at least in part on at least one time constant.

4. The electronic device of claim 3, wherein the processing circuitry is configured to determine the at least one time constant based at least in part on a gray level associated with the second frame of content.

5. The electronic device of claim 4, wherein the processing circuitry is configured to select the at least one time constant based at least in part on:

an on/off state of the electronic display;

a location of the pixel within the electronic display;

a temperature associated with the electronic display; or any combination thereof.

6. The electronic device of claim 3, wherein the processing circuitry is configured to select the at least one time constant based at least in part on:

an on/off state of the electronic display;

a location of the pixel within the electronic display;

a temperature associated with the electronic display; or any combination thereof.

7. The electronic device of claim 1, wherein the processing circuitry comprises one or more analog multiplication units of the electronic display configured to perform mathematical operations utilized to predict the change in threshold voltage associated with the transistor.

8. The electronic device of claim 7, wherein the one or more analog multiplication units of the electronic display are disposed beyond a visible portion of the active area and configured to perform the mathematical operations in an analog domain.

9. The electronic device of claim 8, wherein:

the electronic display comprises analog-to-digital conversion circuitry configured to receive one or more analog signals from the one or more analog multiplication units and convert the one or more analog signals into one or more digitals signals; and the processing circuitry is configured to receive the one or more digital signals and predict the change in threshold voltage associated with the transistor based on the one or more digital signals.

10. A non-transitory computer-readable medium comprising instructions that, when executed, are configured to cause processing circuitry to:

receive image data;

determine, based at least in part on a plurality of time constants, a change in threshold voltage associated with a transistor of a pixel of an electronic display that would occur if the image data were sent to the pixel, wherein each time constant of the plurality of time constants is associated with a different rate of charge trapping and detrapping associated with the transistor;

adjust the image data to generate adjusted image data based at least in part on the determined change in threshold voltage; and cause the pixel to be programmed using the adjusted image data.

11. The non-transitory computer-readable medium of claim 10, wherein:

the image data comprises a first frame of content associated with a first gray level; and the instructions, when executed, are configured to cause the processing circuitry to determine a change in threshold voltage associated with the first frame of content based at least in part on device parameters comprising one or more time constants of the plurality of time constants associated with the first gray level.

12. The non-transitory computer-readable medium of claim 11, wherein:

the device parameters comprise one or more voltages associated with the first gray level; and the instructions, when executed, are configured to cause the processing circuitry to determine the change in threshold voltage based at least in part on the one or more voltages.

13. The non-transitory computer-readable medium of claim 11, wherein the instructions, when executed, are configured to cause the processing circuitry to determine the change in threshold voltage at least in part by:

determining a first change in threshold voltage associated with a first time constant of the one or more time constants;

determining a second change in threshold voltage associated with a second time constant of the one or more time constants; and determining a sum of the first and second changes in threshold voltage.

14. The non-transitory computer-readable medium of claim 11, wherein:

the one or more time constants comprise two or more time constants; and the instructions, when executed, are configured to cause the processing circuitry to:

determine a subset of two or more time constants; and determine the change in threshold voltage based at least in part on the subset of the two or more time constants.

15. The non-transitory computer-readable medium of claim 11, wherein the instructions, when executed, are configured to cause the processing circuitry to determine the change in threshold voltage based at least in part on a change in threshold voltage associated with a second frame of content of the image data that precedes the first frame of content.

16. The non-transitory computer-readable medium of claim 15, wherein:

the processing circuitry comprises one or more analog multiplication units of the electronic display; and the instructions, when executed, are configured to:

cause the one or more analog multiplication units to perform mathematical operations utilized to predict the change in threshold voltage associated with the first frame of content; and cause the processing circuitry to cause the pixel to be programmed by causing a voltage to be provided to a capacitor of the pixel based on the adjusted image data.

17. The non-transitory computer-readable medium of claim 10, wherein the instructions, when executed, are configured to cause the processing circuitry to determine the change in threshold voltage based at least in part on a frame rate associated with image data.

18. A method, comprising:

receiving, via processing circuitry of an electronic device, image data, wherein a first portion of the image data corresponds to a first frame of content and a second portion of the image data corresponds to a second frame of content;

sending the first portion of the image data to a pixel of an electronic display;

causing the pixel to emit light;

determining, via the processing circuitry, a change in threshold voltage of a transistor of the pixel expected to occur when a voltage associated with the second frame of content is provided to the pixel, wherein the processing circuitry is configured to determine the change in threshold voltage based at least in part on a plurality of time constants and a gray level associated with the second frame of content;

adjusting the second portion of the image data based at least in part on the determined change in threshold voltage; and sending the adjusted second portion of image data to the pixel.

19. The method of claim 18, comprising:

determining the plurality of time constants based at least in part on the gray level;

selecting a subset of the plurality of time constants based at least in part on:

a mode of operation of the electronic device;

a location of the pixel within the electronic display;

an on/off state of the electronic display; or a combination thereof; and determining, via the processing circuitry, the change in threshold voltage based at least in part on the subset of the plurality of time constants.

20. The method of claim 18, wherein the transistor comprises a driver thin film transistor (TFT).

* * * * *